US010001714B2

(12) United States Patent
Hirakata et al.

(10) Patent No.: US 10,001,714 B2
(45) Date of Patent: Jun. 19, 2018

(54) ELECTROPHOTOGRAPHIC PHOTOSENSITIVE MEMBER, PROCESS CARTRIDGE, AND IMAGE FORMING APPARATUS

(71) Applicant: FUJI XEROX CO., LTD., Tokyo (JP)

(72) Inventors: Masaki Hirakata, Kanagawa (JP); Takeshi Iwanaga, Kanagawa (JP); Nobuyuki Torigoe, Kanagawa (JP); Hideya Katsuhara, Kanagawa (JP); Yoichi Kigoshi, Kanagawa (JP); Takashi Imai, Kanagawa (JP); Fumiaki Mera, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 14/996,297

(22) Filed: Jan. 15, 2016

(65) Prior Publication Data

US 2017/0090307 A1 Mar. 30, 2017

(30) Foreign Application Priority Data

Sep. 25, 2015 (JP) ..... 2015-188581

(51) Int. Cl.

| | |
|---|---|
| ***G03G 5/047*** | (2006.01) |
| ***G03G 5/05*** | (2006.01) |
| ***G03G 5/087*** | (2006.01) |
| ***G03G 5/06*** | (2006.01) |
| ***G03G 5/147*** | (2006.01) |

(52) U.S. Cl.

CPC ..... *G03G 5/047* (2013.01); *G03G 5/0507* (2013.01); *G03G 5/0564* (2013.01); *G03G 5/0592* (2013.01); *G03G 5/0596* (2013.01); *G03G 5/0696* (2013.01); *G03G 5/087* (2013.01); *G03G 5/14704* (2013.01)

(58) Field of Classification Search

CPC ..... G03G 5/047; G03G 5/087; G03G 5/0696

See application file for complete search history.

(56) References Cited

U.S. PATENT DOCUMENTS

| | | | | |
|---|---|---|---|---|
| 4,848,141 | A | 7/1989 | Oliver et al. | |
| 5,298,617 | A | 3/1994 | Nukada et al. | |
| 5,302,479 | A | 4/1994 | Daimon et al. | |
| 5,459,004 | A | 10/1995 | Katsumi et al. | |
| 7,022,450 | B2 * | 4/2006 | Asano | G03G 5/005 399/346 |
| 7,727,688 | B2 | 6/2010 | Yagi | |
| 7,951,517 | B2 | 5/2011 | Iwanaga et al. | |

(Continued)

FOREIGN PATENT DOCUMENTS

| | | | |
|---|---|---|---|
| EP | 0710893 | A1 | 5/1996 |
| JP | 4-189873 | A | 7/1992 |

(Continued)

*Primary Examiner* — Thorl Chea

(74) *Attorney, Agent, or Firm* — Sughrue Mion, PLLC

(57) ABSTRACT

An electrophotographic photosensitive member includes a conductive base; an organic photosensitive layer disposed on the conductive base, the organic photosensitive layer including a layer that constitutes a surface and contains a charge transport material, a binder resin having a viscosity-average molecular weight less than about 50,000, and silica particles in an amount of about 40% by weight or more; and an inorganic protective layer disposed on the organic photosensitive layer.

8 Claims, 4 Drawing Sheets

(56) References Cited

U.S. PATENT DOCUMENTS

| | | | | |
|---|---|---|---|---|
| 8,404,415 | B2 | 3/2013 | Iwanaga et al. | |
| 2002/0028400 | A1* | 3/2002 | Shimada | G03G 5/047 430/58.05 |
| 2011/0058831 | A1* | 3/2011 | Usami | G03G 15/1645 399/46 |
| 2011/0217640 | A1* | 9/2011 | Hashiba | G03G 15/00 430/56 |
| 2013/0344422 | A1* | 12/2013 | Iwanaga | G03G 5/14708 430/56 |

FOREIGN PATENT DOCUMENTS

| | | | |
|---|---|---|---|
| JP | 5-98181 | A | 4/1993 |
| JP | 5-140472 | A | 6/1993 |
| JP | 5-140473 | A | 6/1993 |
| JP | 5-263007 | A | 10/1993 |
| JP | 5-279591 | A | 10/1993 |
| JP | 7-261417 | A | 10/1995 |
| JP | 8-176293 | A | 7/1996 |
| JP | 8-208820 | A | 8/1996 |
| JP | 2003-316038 | A | 11/2003 |
| JP | 2004-78147 | A | 3/2004 |
| JP | 2005-181992 | A | 7/2005 |
| JP | 2006-10921 | A | 1/2006 |
| JP | 2007-310300 | A | 11/2007 |
| JP | 2008-176056 | A | 7/2008 |
| JP | 2008-268410 | A | 11/2008 |
| JP | 2010-181820 | A | 8/2010 |
| JP | 2012-155282 | A | 8/2012 |

* cited by examiner

ELECTROPHOTOGRAPHIC PHOTOSENSITIVE MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-188581 filed Sep. 25, 2015.

BACKGROUND (i) Technical Field

The present invention relates to an electrophotographic photosensitive member, a process cartridge, and an image forming apparatus.

(ii) Related Art

Electrophotography is a widely prevalent technique employed in copiers, printers, etc. Recent years have seen emergence of a technology of providing a surface layer (protective layer) on a photosensitive layer surface of an electrophotographic photosensitive member (hereinafter may be simply referred to as a "photosensitive member") used in an electrophotographic image forming apparatus.

SUMMARY

According to an aspect of the invention, there is provided an electrophotographic photosensitive member that includes a conductive base; an organic photosensitive layer disposed on the conductive base, the organic photosensitive layer including a layer that constitutes a surface and contains a charge transport material, a binder resin having a viscosity-average molecular weight less than 50,000 or less than about 50,000, and silica particles in an amount of 40% by weight or more or about 40% by weight or more; and an inorganic protective layer disposed on the organic photosensitive layer.

BRIEF DESCRIPTION OF THE DRAWINGS

Exemplary embodiments of the present invention will be described in detail based on the following figures, wherein.

DETAILED DESCRIPTION

Figure 1:
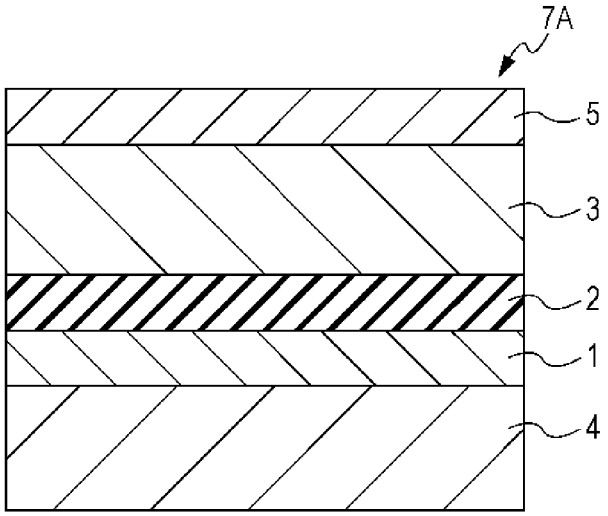
FIG. 1 is a schematic cross-sectional view illustrating an example layer configuration of an electrophotographic photosensitive member according to an exemplary embodiment.

Exemplary embodiments of the present invention will now be described.

Electrophotographic Photosensitive Member

An electrophotographic photosensitive member according to an exemplary embodiment includes a conductive base, an organic photosensitive layer disposed on the conductive base, and an inorganic protective layer disposed on the organic photosensitive layer. A layer that constitutes a surface of the organic photosensitive layer contains a charge transport material, a binder resin, and silica particles. The binder resin has a viscosity-average molecular weight less than 50,000 or less than about 50,000. The amount of the silica particles relative to the entire layer constituting the surface of the organic photosensitive layer is 40% by weight or more or about 40% by weight or more.

Specifically, when the organic photosensitive layer is a single-layer organic photosensitive layer, the organic photosensitive layer contains a charge generation material, a charge transport material, a binder resin having a viscosity-average molecular weight less than 50,000 or less than about 50,000, and 40% by weight or more or about 40% by weight or more of silica particles relative to the entire organic photosensitive layer.

In contrast, when the organic photosensitive layer is a separated-function-type organic photosensitive layer, the organic photosensitive layer includes a charge generation layer and a charge transport layer stacked on a conductive base in that order, and the charge transport layer contains a charge transport material, a binder resin having a viscosity-average molecular weight less than 50,000 or less than about 50,000, and 40% by weight or more or about 40% by weight or more of silica particles relative to the entire charge transport layer. When the charge transport layer includes two or more layers, the charge transport layer constituting a surface layer (uppermost layer of the charge transport layer) contains a charge transport material, a binder resin having a viscosity-average molecular weight less than 50,000 or less than about 50,000, and silica particles.

Forming an inorganic protective layer on an organic photosensitive layer is known in the related art. However, while an organic photosensitive layer has flexibility and a tendency to deform, an inorganic protective layer is hard and tends to have poor toughness. When the organic photosensitive layer which is an underlying layer of the inorganic protective layer deforms, the inorganic protective layer may crack. Since the electrophotographic photosensitive member is often put under a mechanical load from a component (e.g., an intermediate transfer body) arranged to be in contact with the surface of the electrophotographic photosensitive member, this phenomenon occurs easily.

To address this issue, the layer that constitutes the surface of the organic photosensitive layer is designed to contain a charge transport material, a binder resin, and silica particles so that the silica particles serve as a reinforcing material for the organic photosensitive layer. It is considered that the organic photosensitive layer becomes less prone to deforming and the inorganic protective layer suffers less cracking as a result.

When the silica particles that serve as a reinforcing material are contained in the organic photosensitive layer in a large amount (40% by weight or more or about 40% by weight of more), the surface roughness of the organic photosensitive layer tends to increase (in other words, the surface of the photosensitive layer tends to be rough), and the surface roughness of the inorganic protective layer disposed on the organic photosensitive layer (in particular, making contact with the organic photosensitive layer) also tends to increase (in other words, the surface of the photosensitive member tends to be rough as well). The increase in the surface roughness of the organic photosensitive layer decreases the ease of cleaning the surface of the photosensitive member, which induces occurrence of image deletion.

In contrast, since the electrophotographic photosensitive member of the exemplary embodiment uses a binder resin having a viscosity-average molecular weight less than 50,000 in the layer that constitutes the surface of the organic photosensitive layer, the surface roughness of the organic photosensitive layer is easily decreased despite a large amount (40% by weight or more) of silica particles relative to the entire layer that constitutes the surface of the organic photosensitive layer. As a result, the surface roughness of the inorganic protective layer (in other words, the surface roughness of the photosensitive member) disposed on the organic photosensitive layer is easily decreased, and degradation of a cleaning property of the photosensitive member surface is easily suppressed. Since degradation of the cleaning property is suppressed, the amounts of deposits (residual toner, discharge products, etc.) on the surface of the photosensitive member are decreased, and thus occurrence of image deletion in a high-temperature high-humidity environment (for example, a temperature of 28° C. and a humidity of 50% RH) caused by degradation of the cleaning property is suppressed.

According to the electrophotographic photosensitive member of the exemplary embodiment, occurrence of image deletion is suppressed due to the above-described structure.

The electrophotographic photosensitive member according to this exemplary embodiment will now be described in detail with reference to the drawings. In the drawings, the same or equivalent portions are represented by the same reference symbols and the descriptions therefor are omitted to avoid redundancy.

Figure 2:
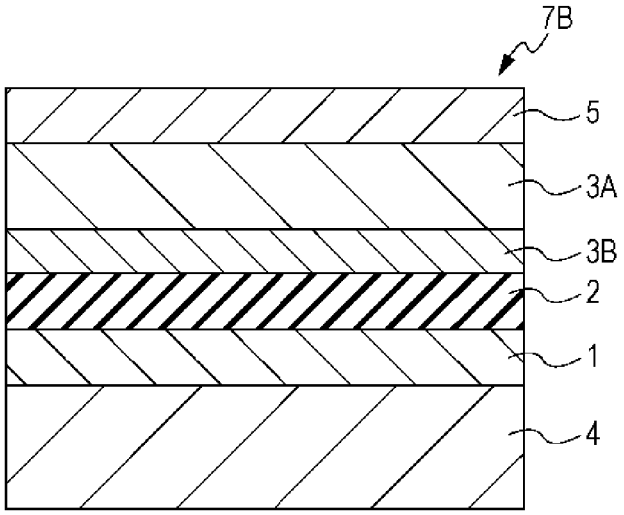
FIG. 2 is a schematic cross-sectional view illustrating another example layer configuration of the electrophotographic photosensitive member according to the exemplary embodiment.
Figure 3:
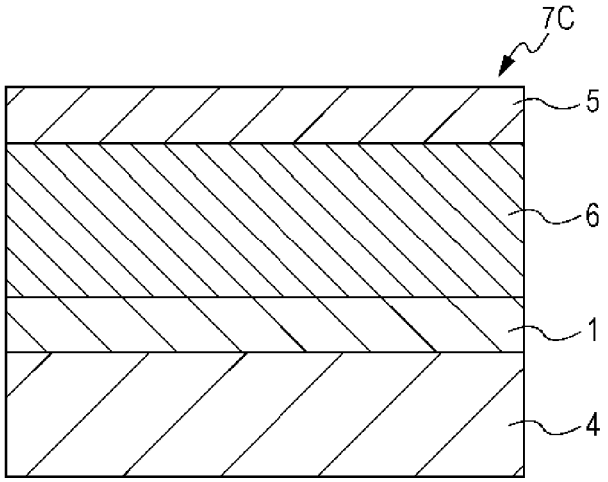
FIG. 3 is a schematic cross-sectional view illustrating yet another example layer configuration of the electrophotographic photosensitive member according to the exemplary embodiment.

FIG. 1 is a schematic cross-sectional view of an example of the electrophotographic photosensitive member according to this exemplary embodiment. FIGS. 2 and 3 are schematic cross-sectional views respectively illustrating other examples of the electrophotographic photosensitive member of the exemplary embodiment.

An electrophotographic photosensitive member 7A illustrated in FIG. 1 is what is known as a separated-function-type photosensitive member (or a multilayer photosensitive member) having a structure in which an undercoat layer 1 is disposed on a conductive base 4, and a charge generation layer 2, a charge transport layer 3, and an inorganic protective layer 5 are sequentially stacked on the undercoat layer 1. In the electrophotographic photosensitive member 7A, the charge generation layer 2 and the charge transport layer 3 constitute an organic photosensitive layer. The charge transport layer 3 contains a charge transport material, a binder resin, and silica particles. The binder resin has a viscosity-average molecular weight less than 50,000. The amount of the silica particles relative to the entire charge transport layer 3 is 40% by weight or more.

An electrophotographic photosensitive member 7B illustrated in FIG. 2 is also a separated-function-type photosensitive member having a structure in which the functions are divided between the charge generation layer 2 and the charge transport layer 3 as in the electrophotographic photosensitive member 7A illustrated in FIG. 1, and the charge transport layer 3 is also of a separated function type. An electrophotographic photosensitive member 7C illustrated in FIG. 3 contains a charge generation material and a charge transport material in the same layer (single-layer-type organic photosensitive layer 6 (charge generation/charge transport layer)).

In the electrophotographic photosensitive member 7B illustrated in FIG. 2, an undercoat layer 1 is disposed on a conductive base 4, and a charge generation layer 2, a charge transport layer 3B, a charge transport layer 3A, and an inorganic protective layer 5 are sequentially stacked on the undercoat layer 1. In the electrophotographic photosensitive member 7B, the charge transport layer 3A, the charge transport layer 3B, and the charge generation layer 2 constitute an organic photosensitive layer.

The charge transport layer 3A is configured to contain a charge transport material, a binder resin, and silica particles. The binder resin has a viscosity-average molecular weight less than 50,000. The amount of the silica particles relative to the entire charge transport layer 3A is 40% by weight or more. The charge transport layer 3B contains at least a charge transport material, and may contain silica particles or no silica particles.

The electrophotographic photosensitive member 7C illustrated in FIG. 3 has a structure in which an undercoat layer 1 is disposed on a conductive base 4 and a single-layer-type organic photosensitive layer 6 and an inorganic protective layer 5 are sequentially stacked on the undercoat layer 1. The single-layer-type organic photosensitive layer 6 is configured to contain a charge transport material, a binder resin, and silica particles. The binder resin has a viscosity-average molecular weight less than 50,000. The amount of the silica particles relative to the single-layer-type organic photosensitive layer 6 is 40% by weight or more.

In the electrophotographic photosensitive members illustrated in FIGS. 1 to 3, the undercoat layer 1 is optional.

Individual components of the electrophotographic photosensitive member 7A illustrated in FIG. 1 as a representative example are described below. The reference numerals are sometimes omitted in the description.

Conductive Base

Examples of the conductive base include metal plates, metal drums, and metal belts that contain metals (aluminum, copper, zinc, chromium, nickel, molybdenum, vanadium, indium, gold, platinum, etc.) or alloys (stainless steels etc.). Other examples of the conductive base include paper, resin films, and belts prepared by performing coating, vapor deposition, or laminating using conductive compounds (for example, conductive polymers and indium oxide), metals (for example, aluminum, palladium, and gold), or alloys. The term "conductive" means that the volume resistivity is less than $10^{13}$ Ωcm.

When the electrophotographic photosensitive member is used in a laser printer, the surface of the conductive base may be roughened so that the center-line average roughness Ra is 0.04 μm or more and 0.5 μm or less. This is to decrease interference fringes that occur during irradiation with a laser beam. When incoherent light is used as a light source, the surface roughening for preventing interference fringes is optional. However, surface roughening decreases occurrence of defects caused by irregularities on the surface of the conductive base and extends the service life.

Examples of the surface roughening technique include wet honing that involves spraying a suspension of an abrasive in water onto a conductive base, centerless grinding that involves pressing a conductive base against a rotating grinding stone to continuously perform grinding, and anodization.

Another example of the surface roughening technique does not involve directly roughening a surface of a conductive base; instead, the technique involves forming a layer on the surface of the conductive base by using a dispersion containing dispersed conductive or semi-conductive powder in a resin so that the rough surface is created by the particles dispersed in that layer.

The surface roughening by anodization involves anodizing a metal (for example, aluminum) conductive base serving as an anode in an electrolyte solution so as to form an oxide film on the surface of the conductive base. Examples of the electrolyte solution include a sulfuric acid solution and an oxalic acid solution. However, a porous anodic oxide film as is formed by anodization is chemically active and susceptible to contamination and undergoes large changes in resistance depending on the environment. Thus, the porous anodic oxide film may be subjected to a pore sealing treatment in which the fine pores of the oxide film are stopped by volume expansion caused by hydration reaction in pressurized water vapor or in boiling water (a metal salt such as a nickel salt may be added) so that the oxide is transformed into a more stable hydrous oxide.

The thickness of the anodic oxide film may be, for example, 0.3 μm or more and 15 μm or less. When the thickness is within this range, a barrier property tends to be exhibited against injection and the increase in residual potential caused by repeated use tends to be suppressed.

The conductive base may be treated with an acidic treatment solution or be subjected to a Boehmite treatment.

The treatment with an acidic treatment solution may be carried out as follows, for example. First, an acidic treatment solution containing phosphoric acid, chromic acid, and hydrofluoric acid is prepared. The blend ratios of the phosphoric acid, chromic acid, and hydrofluoric acid in the acidic treatment solution are, for example, phosphoric acid: 10% by weight or more and 11% by weight or less, chromic acid: 3% by weight or more and 5% by weight or less, hydrofluoric acid: 0.5% by weight or more and 2% by weight or less. The total concentration of all the acids may be in the range of 13.5% by weight or more and 18% by weight or less. The treatment temperature may be, for example, 42° C. or higher and 48° C. or lower. The thickness of the film may be 0.3 μm or more and 15 μm or less.

The Boehmite treatment is carried out by immersing the base in pure water at 90° C. or higher and 100° C. or lower for 5 to 60 minutes or by bringing the base in contact with heated water vapor at 90° C. or higher and 120° C. or lower for 5 to 60 minutes. The thickness of the film may be 0.1 μm or more and 5 μm or less. The treated base may be further subjected to an anodization treatment by using an electrolyte solution having a low film-dissolving property. Examples of the electrolyte here include adipic acid, boric acid, a borate, a phosphate, a phthalate, a maleate, a benzoate, a tartrate, and a citrate.

Undercoat Layer

The undercoat layer is, for example, a layer that contains inorganic particles and a binder resin.

Examples of the inorganic particles include those having powder resistance (volume resistivity) of $10^2$ Ωcm or more and $10^{11}$ Ωcm or less. Examples of the inorganic particles having such a resistivity include metal oxide particles such as tin oxide particles, titanium oxide particles, zinc oxide particles, and zirconium oxide particles. In particular, zinc oxide particles may be used.

The BET specific surface area of the inorganic particles measured may be, for example, 10 $m^2/g$ or more. The volume-average particle diameter of the inorganic particles may be, for example, 50 nm or more and 2000 nm or less (or may be 60 nm or more and 1000 nm or less).

The amount of the inorganic particles relative to the binder resin is, for example, 10% by weight or more and 80% by weight or less, and may be 40% by weight or more and 80% by weight or less.

The inorganic particles may be surface-treated. Two or more types of inorganic particles subjected to different surface treatments or having different particle diameters may be mixed and used.

Examples of the surface treatment agent include silane coupling agents, titanate-based coupling agents, aluminum-based coupling agents, and surfactants. Silane coupling agents are preferable, and amino-group-containing silane coupling agents are more preferable.

Examples of the amino-group-containing silane coupling agent include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used as a mixture. For example, an amino-group-containing silane coupling agent and another silane coupling agent may be used in combination. Examples of the this another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

The surface treatment method using a surface treatment agent may be any known method and may be a dry or wet method.

The amount of the surface treatment agent used in the treatment may be 0.5% by weight or more and 10% by weight or less relative to the inorganic particles.

The undercoat layer may contain inorganic particles and an electron-accepting compound (acceptor compound) from the viewpoints of enhancing long-term stability of electrical characteristics and a carrier blocking property.

Examples of the electron-accepting compound include electron transport substances. Examples thereof include quinone-based compounds such as chloranil and bromanil; tetracyanoquinodimethane-based compounds; fluorenone compounds such as 2,4,7-trinitrofluorenone and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone-based compounds; thiophene compounds; and diphenoquinone compounds such as 3,3',5,5'-tetra-t-butyldiphenoquinone.

A compound having an anthraquinone structure may be used as the electron-accepting compound. Examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer by being co-dispersed with the inorganic particles or by being attached to the surfaces of the inorganic particles.

Examples of the method for attaching the electron-accepting compound onto the surfaces of the inorganic particles include a wet method or a dry method.

According to a dry method, for example, while inorganic particles are being stirred with a mixer having large shear force, an electron-accepting compound as is or as dissolved in an organic solvent is added thereto dropwise or sprayed along with dry air or nitrogen gas so that the electron-accepting compound attaches to the surfaces of the inorganic particles. Dropwise addition or spraying of the electron-accepting compound may be performed at a temperature not higher than the boiling point of the solvent. After dropwise addition or spraying of the electron-accepting compound, baking may be conducted at 100° C. or higher. Baking may be performed at any temperature for any length of time as long as electrophotographic properties are obtained.

According to a wet method, for example, while inorganic particles are being dispersed in a solvent by stirring or by using ultrasonic waves, a sand mill, an attritor, a ball mill, or the like, an electron-accepting compound is added thereto, and after stirring or dispersing, the solvent is removed to have the electron-accepting compound attach to the surfaces of the inorganic particles. Examples of the method for removing the solvent include filtration and distillation. Baking at 100° C. or higher may be conducted after the removal of the solvent. Baking may be performed at any temperature for any length of time as long as electrophotographic properties are obtained. In the wet method, water contained in the inorganic particles may be removed prior to adding the electron-accepting compound. For example, the inorganic particles may be stirred and heated in a solvent to remove water or water may be azeotropically removed with a solvent.

Attaching the electron-accepting compound may be performed before, after, or simultaneously with performing the surface treatment on the inorganic particles by using a surface treatment agent.

The amount of the electron-accepting compound relative to the inorganic particles is, for example, 0.01% by weight or more and 20% by weight or less and may be 0.01% by weight or more and 10% by weight or less.

Examples of the binder resin used in the undercoat layer include known polymer materials such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; and other known materials such as zirconium chelate compounds, titanium chelate compounds, aluminum chelate compounds, titanium alkoxide compounds, organic titanium compounds, and silane coupling agents. Other examples of the binder resin used in the undercoat layer include charge transport resins having charge transport groups and conductive resins (for example, polyaniline).

Among these, a resin insoluble in the coating solvent contained in the overlying layer may be used as the binder resin contained in the undercoat layer. Examples thereof include thermosetting resins such as urea resins, phenolic resins, phenol-formaldehyde resins, melamine resins, urethane resins, unsaturated polyester resins, alkyd resins, and epoxy resins; and resins obtained by reaction between a curing agent and at least one resin selected from the group consisting of a polyamide resin, a polyester resin, a polyether resin, a methacrylic resin, an acrylic resin, a polyvinyl alcohol resin, and a polyvinyl acetal resin. When two or more of these binder resins are used in combination, the mixing ratio is set as desired.

The undercoat layer may contain various additives that improve electrical properties, environmental stability and image quality. Examples of the additives include known materials such as electron transport pigments based on fused polycyclic and azo materials, zirconium chelate compounds, titanium chelate compounds, aluminum chelate compounds, titanium alkoxide compounds, organic titanium compounds, and silane coupling agents. Although a silane coupling agent is used in a surface treatment of inorganic particles as discussed above, it may also be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, zirconium acetylacetonate butoxide, zirconium ethyl acetoacetate butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, polytitanium acetylacetonate, titanium octyleneglycolate, titanium lactate ammonium salt, titanium lactate, titanium lactate ethyl ester, titanium triethanolaminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethyl acetoacetate).

These additives may be used alone, as a mixture of two or more compounds, or as a polycondensation product of two or more compounds.

The undercoat layer may have a Vickers hardness of 35 or more. In order to suppress Moire-images, the surface roughness (ten point average roughness) of the undercoat layer may be adjusted to be in the range of $1/(4n)\lambda$ to $(1/2)\lambda$ where $\lambda$ represents the wavelength of the laser used for exposure and n represents the refractive index of the overlying layer.

Resin particles and the like may be added to the undercoat layer to adjust the surface roughness. Examples of the resin particles include silicone resin particles, and crosslinked polymethyl methacrylate resin particles. The surface of the undercoat layer may be polished to adjust the surface roughness. Examples of the polishing technique include buff polishing, sand blasting, wet honing, and grinding.

The undercoat layer may be formed by any known method. For example, a coating solution for forming an undercoat layer may be prepared by adding the above-described components to a solvent and applied to form a coating film, and the coating film may be dried, and if desirable, heated.

A known organic solvent may be used as the solvent for preparing the coating solution for forming the undercoat layer. Examples of the known organic solvent include alcohol-based solvents, aromatic hydrocarbon solvents, halogenated hydrocarbon solvents, ketone-based solvents, ketone alcohol-based solvents, ether-based solvents, and ester-based solvents.

Specific examples of these solvents include methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the technique for dispersing inorganic particles in preparing the coating solution for forming the undercoat layer include known techniques that use a roll mill, a ball mill, a vibrating ball mill, an attritor, a sand mill, a colloid mill, and a paint shaker.

Examples of the technique for applying the coating solution for forming the undercoat layer onto the conductive base include known techniques such as a blade coating technique, a wire bar coating technique, a spray coating technique, a dip coating technique, a bead coating technique, an air knife coating technique, and a curtain coating technique.

The thickness of the undercoat layer is, for example, 15 μm or more and may be in the range of 20 μm or more and 50 μm or less.

Intermediate Layer

An intermediate layer may be further provided between the undercoat layer and the photosensitive layer although this is not illustrated in the drawings. The intermediate layer is, for example, a layer containing a resin. Examples of the resin used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer that contains an organic metal compound. Examples of the organic metal compound used in the intermediate layer include those which contain metal atoms such as zirconium, titanium, aluminum, manganese, and silicon atoms. The compounds used in the intermediate layer may be used alone, as a mixture of two or more compounds, or as a polycondensation product of two or more compounds.

In particular, the intermediate layer may be a layer that contains an organic metal compound that contains a zirconium atom or a silicon atom.

The intermediate layer may be formed by any known method. For example, a coating solution for forming the intermediate layer may be prepared by adding the above-described components to a solvent and applied to form a coating film, and the coating film may be dried and, if desired, heated. Examples of the technique for applying the solution for forming the intermediate layer include known techniques such as a dip coating technique, a lift coating technique, a wire bar coating technique, a spray coating technique, a blade coating technique, a knife coating technique, and a curtain coating technique.

The thickness of the intermediate layer may be set within the range of 0.1 μm or more and 3 μm or less. The intermediate layer may also serve as an undercoat layer.

Charge Generation Layer

The charge generation layer is a layer that contains a charge generation material and a binder resin. The charge generation layer may be a layer formed by vapor deposition of a charge generation material. The vapor deposited layer of the charge generation material is suitable when an incoherent light source such as a light-emitting diode (LED) or an organic electro-luminescence (EL) image array is used as the light source.

Examples of the charge generation material include azo pigments such as bisazo and trisazo pigments; fused aromatic pigments such as dibromoanthanthrone; perylene pigments; pyrrolopyrrole pigments; phthalocyanine pigments; zinc oxide; and trigonal selenium.

Among these, a metal phthalocyanine pigment or a metal-free phthalocyanine pigment may be used as the charge generation material in order to allow use of near infrared laser exposure. Specific examples thereof include hydroxygallium phthalocyanine disclosed in Japanese Unexamined Patent Application Publication Nos. 5-263007 and 5-279591; chlorogallium phthalocyanine disclosed in Japanese Unexamined Patent Application Publication No. 5-98181; dichlorotin phthalocyanine disclosed in Japanese Unexamined Patent Application Publication Nos. 5-140472 and 5-140473; and titanyl phthalocyanine disclosed in Japanese Unexamined Patent Application Publication No. 4-189873.

In order to allow use of near-ultraviolet laser exposure, the charge generation material may be a fused aromatic pigment such as dibromoanthanthrone, a thioindigo pigment, a porphyrazine compound, zinc oxide, trigonal selenium, or a bisazo pigment disclosed in Japanese Unexamined Patent Application Publication Nos. 2004-78147 and 2005-181992, for example.

The above-described charge generation material may be used in the case where an incoherent light source, such as an LED or organic EL image array, having an emission center wavelength in the range of 450 nm or more and 780 nm or less is used. However, when the photosensitive layer is as thin as 20 μm or less to improve resolution, the field strength in the photosensitive layer increases and electrification resulting from charge injection from the base decreases, thereby readily generating image defects known as black spots. This phenomenon is notable when a charge generation material, such as trigonal selenium or a phthalocyanine pigment, that is a p-type semiconductor and readily generates dark current is used.

In contrast, when an n-type semiconductor such as a fused aromatic pigment, a perylene pigment, or an azo pigment is used as the charge generation material, dark current rarely occurs and fewer image defects called black spots occur despite a small thickness. Examples of the n-type charge generation material include, but are not limited to, compounds (CG-1) to (CG-27) described in paragraphs 0288 to 0291 in Japanese Unexamined Patent Application Publication No. 2012-155282. Whether the semiconductor is n-type or not is determined by a typical time-of-flight technique in which the polarity of photoelectric current flowing therein is determined and a compound that allows electrons rather than holes to flow as a carrier is determined to be the n-type.

The binder resin used in the charge generation layer is selected from a wide variety of insulating resins. The binder resin may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (polycondensation products of bisphenols and aromatic divalent carboxylic acids, etc.), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is $10^{13}$ Ωcm or more. These binder resins may be used alone or as a mixture or two or more.

The blend ratio of the charge generation material to the binder resin may be within the range of 10:1 to 1:10 on a weight basis.

The charge generation layer may contain other known additives.

The charge generation layer may be formed by any known method. For example, a coating solution for forming a charge generation layer may be prepared by adding the above-described components to a solvent and applied to form a coating film, and the coating film may be dried and, if desired, heated. The charge generation layer may also be formed by vapor deposition of a charge generation material. Formation of the charge generation layer by vapor deposition may be employed when a fused aromatic pigment or a perylene pigment is used as the charge generation material.

Examples of the solvent for preparing the coating solution for forming the charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or as a mixture of two or more.

The technique for dispersing particles (for example, a charge generation material) in the coating solution for forming a charge generation layer includes those which use a medium disperser such as a ball mill, a vibrating ball mill, an attritor, a sand mill, or a horizontal sand mill, and a medium-less disperser such as an agitator, an ultrasonic disperser, a roll mill, and a high-pressure homogenizer. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure. In conducting dispersion, it is effective to control the average particle diameter of the charge generation material in the coating solution for forming a charge generation layer to 0.5 μm or less, preferably 0.3 μm or less, and more preferably 0.15 μm or less.

Examples of the technique of applying the coating solution for forming a charge generation layer onto the undercoat layer (or intermediate layer) include typical techniques such as a blade coating technique, a wire bar coating technique, a spray coating technique, a dip coating technique, a bead coating technique, an air knife coating technique, and a curtain coating technique.

The thickness of the charge generation layer may be, for example, 0.1 μm or more and 5.0 μm or less in some cases and may be 0.2 μm or more and 2.0 μm or less in some cases.

Charge Transport Layer

Composition of Charge Transport Layer

The charge transport layer contains a charge transport material, a binder resin, and silica particles. The binder resin has a viscosity-average molecular weight less than 50,000. The amount of the silica particles relative to the entire charge transport layer is 40% by weight or more.

Examples of the charge transport material include quinone-based compounds such as p-benzoquinone, chloranil, bromanil, and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds. Examples of hole transport compounds that may be used as the charge transport material include triarylamine-based compounds, benzidine-based compounds, aryl alkane-based compounds, aryl-substituted ethylene-based compounds, stilbene-based compounds, anthracene-based compounds, and hydrazone-based compounds. These charge transport materials are non-limiting examples and may be used alone or in combination.

From the viewpoint of charge mobility, the charge transport material may be a triarylamine derivative represented by structural formula (a-1) below or a benzidine derivative represented by structural formula (a-2) below.

(a-1)

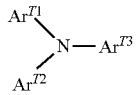

In structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent for the groups described above.

(a-2)

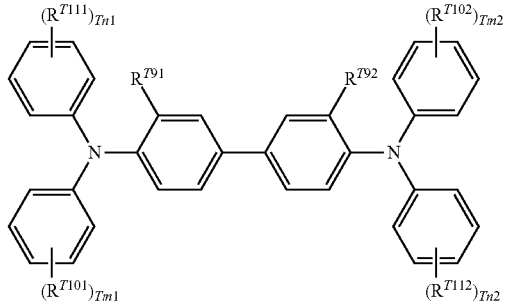

In structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, —C($R^{T12}$)=C($R^{T13}$)($R^{T14}$), or —CH=CH—CH=C($R^{T15}$)($R^{T16}$). $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. $Tm_1$, $Tm_2$, $Tn_1$, and $Tn_2$ each independently represent an integer of 0 or more and 2 or less.

Examples of the substituents of the groups described above include a halogen atom, an alkyl group having 1 to 5 carbon atoms, and an alkoxy group having 1 to 5 carbon atoms. A substituted amino group substituted with an alkyl group having 1 to 3 carbon atoms may also be used as the substituent of the group.

Among the triarylamine derivatives represented by structural formula (a-1) and benzidine derivatives represented by structural formula (a-2), triarylamine derivatives having "—$C_6H_4$—CH=CH—CH=C($R^{T7}$)($R^{T8}$)" and benzidine derivatives having "—CH=CH—CH=C($R^{T15}$)($R^{T16}$)" are preferable from the viewpoint of charge mobility.

Charge transport materials that are commonly available such as poly-N-vinyl carbazole and polysilane are used as the polymer charge transport material. Specifically, polyester-based polymer charge transport materials disclosed in Japanese Unexamined Patent Application Publication Nos. 8-176293 and 8-208820 may be used. The polymer charge transport material may be used alone or in combination with a binder resin.

In this exemplary embodiment, the amount of the silica particles relative to the entire charge transport layer is 40% by weight or more or about 40% by weight of more to suppress occurrence of cracks in the inorganic protective layer. The amount of the silica particles may be 45% by weight or more or about 45% by weight or more, or 50% by weight or more or about 50% by weight or more from the same perspective. The upper limit is not particularly limited and may be 70% by weight or less, preferably 65% by weight or less, and more preferably 60% by weight or less in order for the charge transport layer to have charge transport properties.

Examples of the silica particles include dry process silica particles and wet process silica particles. Examples of the dry process silica particles include pyrogenic silica (fumed silica) obtained by burning silane compounds and deflagration silica obtained by deflagrating metal silicon powder. Examples of the wet process silica particles include wet silica particles obtained by neutralization reaction between sodium silicate and mineral acid (precipitated silica synthesized and aggregated under alkaline conditions and gel silica particles synthesized and aggregated under acidic conditions), colloidal silica particles obtained by alkalinizing and polymerizing acidic silicates (silica sol particles), and sol-gel silica particles obtained by hydrolysis of organic silane compounds (for example, alkoxy silane).

Among these, pyrogenic silica particles having fewer silanol groups at the surface and a low-porosity structure are preferable from the viewpoint of suppressing image defects (suppressing degradation of thin line reproducibility) caused by generation of residual potential and other degradation of electrical properties.

The volume-average particle diameter of the silica particles is preferably 20 nm or more and 200 nm or less or about 20 nm or more and about 200 nm or less, more preferably 40 nm or more and 150 nm or less, yet more preferably 50 nm or more and 120 nm or less, and most preferably 50 nm or more and 110 nm or less.

When silica particles having a volume-average particle diameter within the above-described range are used in combination with a binder resin having a viscosity-average molecular weight less than 50,000, the surface roughness of the charge transport layer is more easily decreased and occurrence of image deletion is more easily suppressed.

The volume-average particle diameter of the silica particles is measured by separating silica particles from the layer, observing 100 primary particles of the silica particles with a scanning electron microscope (SEM) at a magnification of 40,000, measuring the longest axis and the shortest axis of each particle by image analysis of the primary particles, determining the equivalent circle diameter from the intermediate value, determining a 50% diameter (D50v) from the cumulative frequency of the obtained equivalent circle diameters, and assuming the result to be the volume-average particle diameter of the silica particles.

The silica particles may be surface-treated with a hydrophobing agent. The surface treatment decreases the number of silanol groups on the surfaces of the silica particles and tends to suppress generation of residual potential. Examples of the hydrophobing agent include common silane compounds such as chlorosilane, alkoxysilane, and silazane. Among these, a silane compound having a trimethylsilyl group, a decylsilyl group, or a phenylsilyl group is preferable from the viewpoint of ease of suppressing generation of residual potential. In other words, the surfaces of the silica particles may have trimethylsilyl groups, decylsilyl groups, or phenylsilyl groups.

Examples of the silane compound having a trimethylsilyl group include trimethylchlorosilane, trimethylmethoxysilane, and 1,1,1,3,3,3-hexamethyldisilazane. Examples of the silane compound having a decylsilyl group include decyltrichlorosilane, decyldimethylchlorosilane, and decyltrimethoxysilane. Examples of the silane compound having a phenylsilyl group include triphenylmethoxysilane and triphenylchlorosilane.

The condensation ratio of the hydrophobized silica particles (the ratio of Si—O—Si in $SiO_4$— bonds in the silica particles, hereinafter, this ratio is referred to as a "hydrophobing agent condensation ratio") is, for example, 90% or more, preferably 91% or more, and more preferably 95% or more relative to the silanol groups on the surfaces of the silica particles. When the hydrophobing agent condensation ratio is within the above-described range, the number of silanol groups on the silica particles is decreased and generation of residual potential is more easily suppressed.

The hydrophobing agent condensation ratio indicates the ratio of condensed silicon atoms to all sites capable of bonding to silicon atoms in the condensed portions detected by NMR and is measured as follows.

First, silica particles are separated from the layer. The separated silica particles are subjected to Si CP/MAS NMR analysis with AVANCE III 400 produced by Bruker to determine the peak areas according to the number of substituted SiO. The values for disubstituted ($Si(OH)_2(0\text{-}Si)_2$—), trisubstituted ($Si(OH)(0\text{-}Si)_3$—), and tetrasubstituted ($Si(0\text{-}Si)_4$—) segments are respectively assumed to be Q2, Q3, and Q4. The hydrophobing agent condensation ratio is given by formula $(Q2\times2+Q3\times3+Q4\times4)/4\times(Q2+Q3+Q4)$.

The volume resistivity of the silica particles is, for example, $10^{11}$ Ω·cm or more, preferably $10^{12}$ Ω·cm or more, and more preferably $10^{13}$ Ω·cm or more. When the volume resistivity of the silica particles is within the above-described range, degradation of electrical properties is suppressed.

The volume resistivity of the silica particles is measured as follows. The measurement environment is a temperature of 20° C. and a humidity of 50% RH.

First, silica particles are separated from the layer. The separated silica particles which are the measurement object are placed on a surface of a circular jig equipped with a 20 $cm^2$ electrode plate in such a manner that the thickness of a layer formed by the silica particles is about 1 mm or more and about 3 mm or less. An identical 20 $cm^2$ electrode plate is placed on the silica particle layer so as to sandwich the silica particle layers with the electrode plates. In order to eliminate voids between the silica particles, a load of 4 kg is applied on the electrode plate placed on the silica particle layer and then the thickness (cm) of the silica particle layer is measured. The two electrode plates sandwiching the hydrophobic silica particle layer are connected to an electrometer and a high-voltage power generator. A high voltage is applied to the two electrodes so that a predetermined electric field is created and the value (A) of the current flowing at that time is measured to calculate the volume resistivity (Ω·cm) of the silica particles. The calculation formula for the volume resistivity (Ω·cm) of the silica particles is as follows:

$$\rho = E \times 20/(I - I_0)/L$$

where ρ represents a volume resistivity (Ω·cm) of hydrophobic silica particles, E represents an applied voltage (V), I represents a current value (A), $I_0$ represents a current value (A) at an applied voltage of 0 V, and L represents a thickness (cm) of the hydrophobic silica particle layer. In evaluation, the volume resistivity at an applied voltage of 1,000 V is used.

The binder resin used in the charge transport layer has a viscosity-average molecular weight less than 50,000. When the viscosity-average molecular weight of the binder resin is less than 50,000, the surface roughness of the charge transport layer is easily decreased. The lower limit of the viscosity-average molecular weight is not particularly limited but may be 20,000 or more from the viewpoint of maintaining the properties of the binder resin. In order to more easily decrease the surface roughness of the charge transport layer and further suppress occurrence of image deletion, the viscosity-average molecular weight is preferably 45,000 or less or about 45,000 or less, more preferably 40,000 or less or about 40,000 or less, yet more preferably 38,000 or less, still more preferably 35,000 or less, and most preferably 30,000 or less or about 30,000 or less.

The viscosity-average molecular weight of the binder resin is measured by the following single-point determination method. First, the inorganic protective layer is removed from the photosensitive member which is the measurement object. Then a photosensitive layer to be measured is exposed. A part of the photosensitive layer is scraped to prepare a measurement sample. Then the binder resin is extracted from the measurement sample. In 100 $cm^3$ of methylene chloride, 1 g of the extracted binder resin is dissolved, and a specific viscosity ηsp of the resulting product is measured with a Ubbelohde viscometer in a measurement environment of 25° C. Then an intrinsic viscosity [η] ($cm^3/g$) is determined from the formula $\eta sp/c = [\eta] + 0.45[\eta]^2 c$ (where c represents a concentration ($g/cm^3$)), and the viscosity-average molecular weight Mv is determined from the formula $[\eta] = 1.23 \times 10^{-4}\ Mv^{0.83}$ given by H. Schnell.

Specific examples of the binder resin include polycarbonate resins (homopolymeric resins such as bisphenol A, bisphenol Z, bisphenol C, and bisphenol TP, and copolymer resins thereof), polyarylate resins, polyester resins, methacrylic resins, acrylic resins, polyvinyl chloride resins, polyvinylidene chloride resins, polystyrene resins, acrylonitrile-styrene copolymers, acrylonitrile-butadiene copolymers, polyvinyl acetate resins, styrene-butadiene copolymers, vinyl chloride-vinyl acetate copolymers, vinyl chloride-vinyl acetate-maleic anhydride copolymers, silicone resins, silicone-alkyd resins, phenol-formaldehyde resins, styrene-acryl copolymers, styrene-alkyd resins, poly-N-vinylcarbazole resins, polyvinyl butyral resins, and polyphenylene ether resins. These binder resins are used alone or in combination of two or more. The blend ratio of the charge transport material to the binder resin may be in the range of 10:1 to 1:5 on a weight basis.

In order to more easily decrease the surface roughness of the charge transport layer and further suppress occurrence of image deletion, polycarbonate resins (homopolymeric resins such as bisphenol A, bisphenol Z, bisphenol C, and bisphenol TP, and copolymer resins thereof) are preferable among the binder resins described above. The polycarbonate resins may be used alone or in combination of two or more. From the same reason, a bisphenol Z homopolymeric polycarbonate resin is preferred among the polycarbonate resins.

Properties of Charge Transport Layer

In this exemplary embodiment, the surface roughness Ra (arithmetic average surface roughness Ra) of a surface of the charge transport layer on which the inorganic protective layer is formed is, for example, less than 5 nm, preferably 4.5 nm or less, more preferably 4 nm or less, yet more preferably 3 nm or less, and most preferably 2.5 nm or less in order to further suppress image deletion. The lower limit is not particularly limited and may be 1 nm or more or more preferably 1.2 nm or more. The measurement limit is 1 nm and measurement of the surface roughness less than 1 nm is difficult.

In this exemplary embodiment, since the surface roughness Ra (arithmetic average surface roughness Ra) of the surface of the charge transport layer on which the inorganic protective layer is formed is low, there is a limit to measuring the surface roughness with a probe-type surface roughness meter. Thus, in this exemplary embodiment, the surface roughness Ra is measured with an atomic force microscope (AFM).

Specifically, the inorganic protective layer is first separated to expose the surface to be measured. A part of that layer is cut out with a cutter, for example, to obtain a measurement sample. The measurement sample is analyzed and observed with an atomic force microscope (Nanopics 1000 produced by Seiko Instruments Inc.) under the conditions of measurement area: 400 $\mu m^2$, scan speed: 640. The arithmetic average surface roughness Ra in the four corners and a 25 $\mu m^2$ region at the center of the scan area is determined.

The elastic modulus of the charge transport layer is, for example, 5 GPa or more and may be 6 GPa or more. When the elastic modulus of the charge transport layer is within the above-described range, cracking of the inorganic protective layer is easily suppressed. The elastic modulus of the charge transport layer may be adjusted within the above-described range by controlling the particle diameter and amount of the silica particles or by adjusting the type and amount of the charge transport material, for example.

The elastic modulus of the charge transport layer is measured as follows.

First, the inorganic protective layer is removed to expose the layer to be measured. A part of that layer is cut out with a cutter to obtain a measurement sample. The measurement sample is analyzed with Nano Indenter SA2 produced by MTS Systems Corporation by continuous stiffness measurement (CSM) (U.S. Pat. No. 4,848,141) to obtain a depth profile, and the average is calculated from the values observed at an indent depth of 30 nm to 100 nm.

The thickness of the charge transport layer is, for example, 10 μm or more and 40 μm or less, preferably 10 μm or more and 35 μm or less, and more preferably 15 μm or more and 30 μm or less. When the thickness of the charge transport layer is within this range, cracking of the inorganic protective layer and generation of residual potential are easily suppressed.

Formation of Charge Transport Layer

A charge transport layer may be formed by any available forming method. For example, a coating solution for forming a charge transport layer is prepared by adding the above-described components to a solvent, a coating film is formed by using the coating solution, and the coating film is dried, and if desirable, heated to form a charge transport layer.

Examples of the technique for applying the coating solution for forming a charge transport layer to the charge generation layer include known techniques such as a dip coating technique, a lift coating technique, a wire bar coating technique, a spray coating technique, a blade coating technique, a knife coating technique, and a curtain coating technique.

When particles (for example, silica particles or fluorocarbon resin particles) are dispersed in the coating solution for forming a charge transport layer, a medium disperser such as a ball mill, a vibrating ball mill, an attritor, a sand mill, or a horizontal sand mill or a medium-less disperser such as an agitator, an ultrasonic disperser, a roll mill, or a high-pressure homogenizer is employed. Examples of the high-pressure homogenizers include collision-type homogenizers with which a dispersion is dispersed under a high pressure through liquid-liquid collision or liquid-wall collision, or a penetration-type homogenizer with which a material is caused to penetrate through narrow channels under a high pressure.

Inorganic Protective Layer

Composition of Inorganic Protective Layer

The inorganic protective layer is a layer that contains an inorganic material.

Examples of the inorganic material include oxide-based, nitride-based, carbon-based, and silicon-based inorganic materials since they offer mechanical strength and a light-transmitting property sufficient for a protective layer.

Examples of the oxide-based inorganic materials include metal oxides such as gallium oxide, aluminum oxide, zinc oxide, titanium oxide, indium oxide, tin oxide, and boron oxide, and mixed crystals of the foregoing. Examples of the nitride-based inorganic materials include metal nitrides such as gallium nitride, aluminum nitride, zinc nitride, titanium nitride, indium nitride, tin nitride, and boron nitride, and mixed crystals of the foregoing. Examples of the carbon-based and silicon-based inorganic materials include diamond-like carbon (DLC), amorphous carbon (a-C), hydrogenated amorphous carbon (a-C:H), hydrogenated and fluorinated amorphous carbon (a-C:H:F), amorphous silicon carbide (a-SiC), hydrogenated amorphous silicon carbide (a-SiC:H), amorphous silicon (a-Si), and hydrogenated amorphous silicon (a-Si:H). The inorganic material may be mixed crystals of oxide- and nitride-based inorganic materials.

Among these, metal oxides have excellent mechanical strength and light-transmitting property, and n-type conductivity, and excellent conductivity controllability. Thus, metal oxides, in particular, oxides of group 13 elements (in particular, gallium oxide) may be used to form the inorganic protective layer.

That is, the inorganic protective layer may contain at least a group 13 element (in particular, gallium) and oxygen, and optionally hydrogen. Incorporation of hydrogen facilitates control of various properties of the inorganic protective layer containing the group 13 element (in particular, gallium) and oxygen. For example, in an inorganic protective layer containing gallium, oxygen, and hydrogen (for example, an inorganic protective layer containing hydrogen-containing gallium oxide), changing the [O]/[Ga] compositional ratio from 1.0 to 1.5 facilitates controlling the volume resistivity within the range of $10^9$ Ω·cm or more and $10^{14}$ Ω·cm or less.

The inorganic protective layer may contain, in addition to the above-described inorganic materials, at least one element selected from C, Si, Ge, and Sn in order for the inorganic protective layer to be n-type. If the conductivity type is to be p-type, the inorganic protective layer may contain at least one element selected from N, Be, Mg, Ca, and Sr.

If the inorganic protective layer contains gallium, oxygen, and optionally hydrogen, the element constitutional ratio may be as follows from the viewpoint of obtaining excellent mechanical strength, light-transmitting property, flexibility, and conductivity controllability.

The ratio of gallium relative to all constitutional elements in the inorganic protective layer is, for example, preferably 15 atom % or more and 50 atom % or less, more preferably 20 atom % or more and 40 atom % or less, and most preferably 20 atom % or more and 30 atom % or less.

The ratio of oxygen relative to all constitutional elements in the inorganic protective layer is, for example, preferably 30 atom % or more and 70 atom % or less, more preferably 40 atom % or more and 60 atom % or less, and most preferably 45 atom % or more and 55 atom % or less.

The ratio of hydrogen relative to all constitutional elements in the inorganic protective layer is, for example, preferably 10 atom % or more and 40 atom % or less, more preferably 15 atom % or more and 35 atom % or less, and most preferably 20 atom % or more and 30 atom % or less.

The oxygen/gallium atomic ratio is preferably more than 1.50 but not more than 2.20 and more preferably 1.6 or more and 2.0 or less.

The element constitutional ratios of the respective elements constituting the inorganic protective layer, the atomic ratio, etc., are determined by Rutherford backscattering (hereinafter referred to as "RBS"). The distributions in the thickness direction are also determined by RBS.

In RBS, 3SDH Pelletron produced by National Electrostatics Corporation (NEC) is used as an accelerator, RBS-400 (produced by CE&A Co., Ltd.) is used as an endstation, and 3S-R10 is used as a system. A HYPRA program produced by CE&A Co., Ltd., and the like are used in the analysis.

The RBS measurement conditions are as follows: He++ ion beam energy: 2.275 eV, detection angle: 160°, grazing angle relative to incident beam: about 109°.

RBS measurement is conducted as follows.

First, a He++ ion beam is applied perpendicular to the sample and a detector is positioned at an angle of 160° with respect to the ion beam to measure the signals of backscattered He. The energy and strength of the detected He determine the compositional ratio and the film thickness. The spectrum may be measured at two detection angles in order to improve accuracy of determining the compositional ratio and film thickness. Conducting measurement at two detection angles having different depth-direction resolution and backscattering dynamics and performing cross-checking improve accuracy.

The number of the He atoms backscattered by the target atoms is determined only from the three factors, namely, 1) the atomic number of the target atom, 2) energy of He atoms before scattering, and 3) scattering angle. The density is predicted from the detected composition through calculation and the thickness is determined by using the density. The margin of error in determining the density is within 20%.

The hydrogen ratio is determined by hydrogen forward scattering (hereinafter referred to as "HFS"). In HFS measurement, 3SDH Pelletron produced by National Electrostatics Corporation (NEC) is used as an accelerator, RBS-400 produced by CE&A Co., Ltd., is used as an endstation, and 3S-R10 is used as a system. A HYPRA program produced by CE&A Co., Ltd., and the like are used in the analysis. The HFS measurement conditions are as follows: He++ ion beam energy: 2.275 eV, detection angle: 160°, and grazing angle with respect to incident beam: 30°.

In the HFS measurement, the detector is positioned at 30° with respect to the He++ ion beam and the sample is positioned at 75° with respect to the normal line so as to pick up signals of hydrogen scattered forward out of the sample. During this process, the detector may be covered with an aluminum foil to remove the He atoms scattering with hydrogen. Quantitative determination is conducted by normalizing the hydrogen counts of the reference samples and the measured sample by a stopping power and then comparing the normalized counts. A sample formed of Si and H ion-implanted in Si and white mica are used as the reference samples. White mica is known to have a hydrogen concentration of 6.5 atom %. The hydrogen count is corrected by subtracting the number of H atoms adhering to the clean Si surface, for example, so as to count out H adhering to the outermost surface.

Properties of Inorganic Protective Layer

The inorganic protective layer may have a compositional ratio distribution in the thickness direction or may have a multilayer structure depending on the purpose.

The inorganic protective layer may be a non-single-crystal film such as a microcrystalline film, a polycrystalline film, or an amorphous film. An amorphous film is preferable since it has a smooth and flat surface and a microcrystalline is more preferable from the viewpoint of hardness.

A growth section of the inorganic protective layer may have a columnar structure. From the viewpoint of slidability, the growth section may have a highly flat structure and thus may be amorphous. Crystallinity and amorphousness are determined by the presence or absence of spots and lines in diffraction diagrams obtained by reflection high energy electron diffraction (RHEED) measurement.

The volume resistivity of the inorganic protective layer is, for example, $10^6$ Ω·cm or more and may be $10^8$ Ω·cm or more. When the volume resistivity is within this range, charges rarely flow in the surface direction and electrostatic latent images are formed smoothly.

The volume resistivity is determined by measuring the resistance values with LCR meter ZM2371 produced by NF Corporation at a frequency of 1 kHz and a voltage of 1 V and calculating the volume resistivity from the measured resistance value, the electrode area, and the sample thickness.

The measurement sample may be a sample prepared by forming a layer on an aluminum base under the same conditions as those for forming the inorganic protective layer to be measured and forming a gold electrode on the deposited layer by vacuum vapor deposition. Alternatively, the measurement sample may be a sample prepared by separating the inorganic protective layer from an already prepared electrophotographic photosensitive member, partly etching the separated inorganic protective layer, and sandwiching the etched inorganic protective layer between a pair of electrodes.

The elastic modulus of the inorganic protective layer is 30 GPa or more and 80 GPa or less and may be 40 GPa or more and 65 GPa or less. When the elastic modulus is within this range, generation of nicks (dents), cracking, and separation in the inorganic protective layer are likely to be suppressed.

The elastic modulus is determined by using Nano Indenter SA2 produced by MTS Systems Corporation by continuous stiffness measurement (CSM) (U.S. Pat. No. 4,848,141) to obtain a depth profile, and calculating the average from the values observed at an indent depth of 30 nm to 100 nm. The measurement conditions are as follows:

Measurement environment: 23° C., 55% RH

Indenter used: regular triangle pyramid indenter made of diamond (Berkovich indenter)

Testing mode: CSM mode

The measurement sample may be a sample prepared by forming a film on a base under the same conditions as those for forming the inorganic protective layer to be measured, or may be a sample prepared by separating the inorganic protective layer from an already prepared electrophotographic photosensitive member and partially etching the separated inorganic protective layer.

The thickness of the inorganic protective layer is, for example, 0.2 μm or more and 10.0 μm or less or may be 0.4 μm or more and 5.0 μm or less. When the thickness is within this range, generation of nicks (dents), cracking, and separation of the inorganic protective layer are likely to be suppressed.

The surface roughness Ra (arithmetic average surface roughness Ra) of the surface of the inorganic protective layer of this exemplary embodiment is, for example, 6 nm or less, preferably 5 nm or less, more preferably 4.5 nm or less, yet more preferably 4 nm or less, and most preferably 3.5 nm or less in order to suppress image deletion. The lower limit is not particularly limited and may be 1 nm or more or 1.2 nm or more. The measurement limit is 1 nm, and it is difficult to measure surface roughness less than 1 nm.

The surface roughness Ra of the surface of the inorganic protective layer of this exemplary embodiment is measured with an atomic force microscope (AFM). Specifically, a part of the organic photosensitive layer including the inorganic protective layer is cut out with a cutter or the like to obtain a measurement sample. The measurement sample is measured and analyzed with an atomic force microscope (Nanopics 1000 produced by Seiko Instruments Inc.) under the conditions of measurement area: 400 $\mu m^2$, scan speed: 640. The arithmetic average surface roughness Ra values in the four corners of the scan area and a 25 $\mu m^2$ region at the center are averaged and the result is assumed to be the surface roughness Ra.

Formation of Inorganic Protective Layer

Examples of the technique used to form a protective layer include commonly employed vapor phase film-forming techniques such as a plasma chemical vapor deposition (CVD) technique, an metal organic chemical vapor deposition technique, a molecular beam epitaxy technique, vapor deposition, and sputtering.

Formation of an inorganic protective layer is described below as a specific example while describing an example of a film forming device through the drawings. Although the description below concerns the method for forming an inorganic protective layer that contains gallium, oxygen, and hydrogen, the method is not limited to this. Any common method may be employed depending on the intended composition of the inorganic protective layer.

Figure 4A:
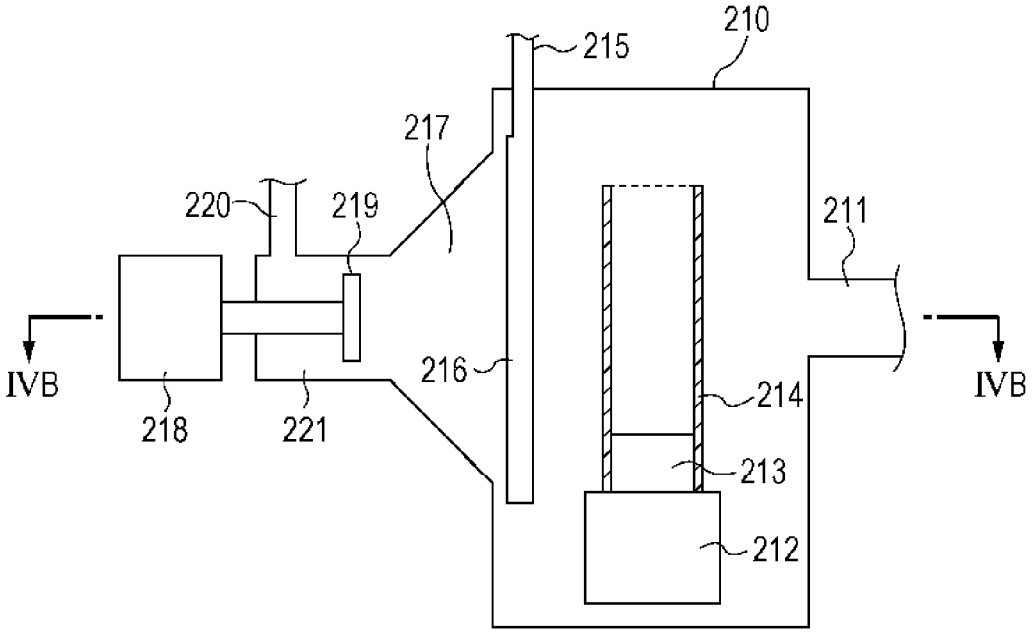
FIGS. 4A and 4B are schematic diagrams illustrating an example of a film forming device used to form an inorganic protective layer of the electrophotographic photosensitive member of the exemplary embodiment.
Figure 4B:
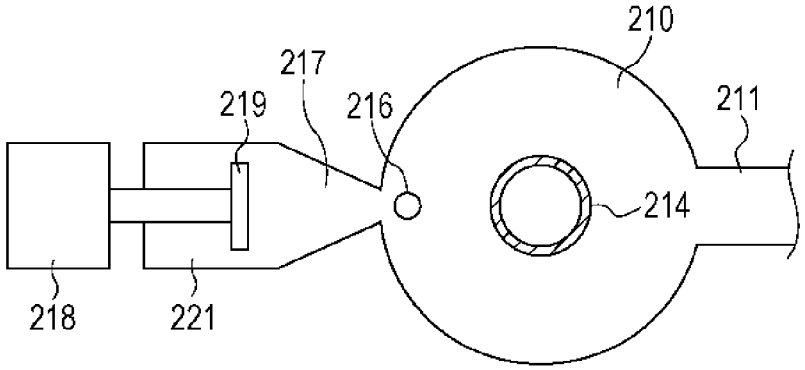

FIGS. 4A and 4B are each a schematic diagram of an example of a film forming device used in forming an inorganic protective layer of an electrophotographic photosensitive member according to the exemplary embodiment. FIG. 4A is a schematic cross-sectional view of the film forming device as viewed from a side, and FIG. 4B is a schematic cross-sectional view of the film forming device taken along line IVB-IVB in FIG. 4A. In FIGS. 4A and 4B, reference numeral 210 denotes a deposition chamber, 211 denotes an exhaust, 212 denotes a base rotating unit, 213 denotes a base supporting unit, 214 denotes a base, 215 denotes a gas inlet duct, 216 denotes a shower nozzle having an opening through which gas introduced from the gas inlet duct 215 is injected, 217 denotes a plasma diffusing unit, 218 denotes a high-frequency power supply unit, 219 denotes a plate electrode, 220 denotes a gas inlet duct, and 221 denotes a high-frequency discharge tube.

In the film forming device illustrated in FIGS. 4A and 4B, the exhaust 211 connected to a vacuum evacuator not illustrated in the drawing is provided at one end of the deposition chamber 210. A plasma generator that includes the high-frequency power supply unit 218, the plate electrode 219, and the high-frequency discharge tube 221 is provided to the deposition chamber 210 on the side opposite to where the exhaust 211 is installed.

This plasma generator is constituted by the high-frequency discharge tube 221, the plate electrode 219 installed within the high-frequency discharge tube 221 and having a discharge surface positioned on the exhaust 211 side, and the high-frequency power supply unit 218 disposed outside the high-frequency discharge tube 221 and connected to a surface of the plate electrode 219 opposite of the discharge surface. The gas inlet duct 220 through which gas is supplied to the interior of the high-frequency discharge tube 221 is connected to the high-frequency discharge tube 221, and the other end of the gas inlet duct 220 is connected to a first gas supply source not illustrated in the drawings.

Figure 5:
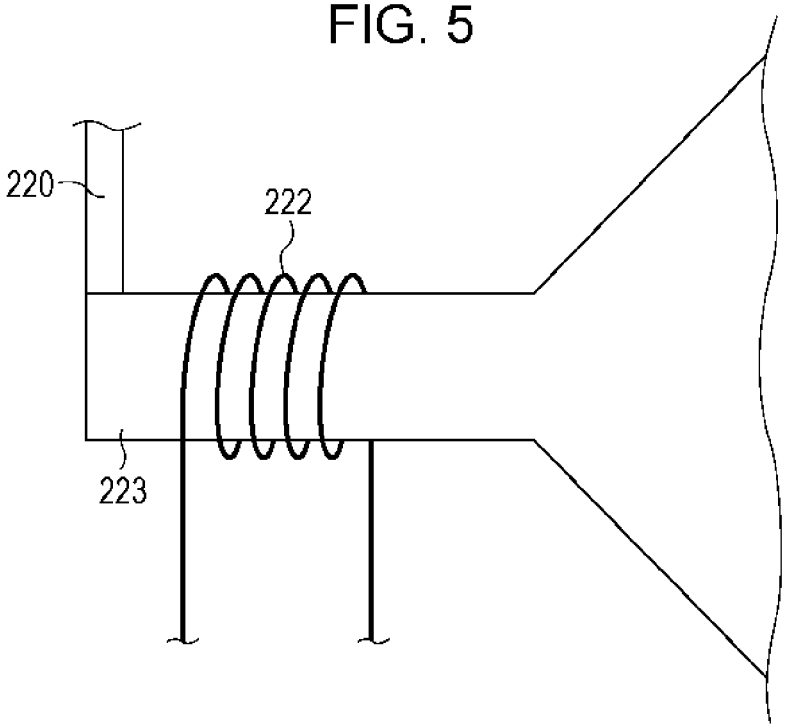
FIG. 5 is a schematic diagram illustrating an example of a plasma generator used to form the inorganic protective layer of the electrophotographic photosensitive member of the exemplary embodiment.

Instead of the plasma generator in the film forming device illustrated in FIGS. 4A and 4B, a plasma generator illustrated in FIG. 5 may be used. FIG. 5 is a schematic diagram illustrating another example of the plasma generator used in the film forming device illustrated n FIGS. 4A and 4B. FIG. 5 is a side view of the plasma generator. In FIG. 5, reference numeral 222 denotes a high-frequency coil, 223 denotes a quartz tube, and 220 is the same as the one illustrated in FIGS. 4A and 4B. The plasma generator includes the quartz tube 223 and the high-frequency coil 222 disposed along the outer peripheral surface of the quartz tube 223. One end of the quartz tube 223 is connected to the deposition chamber 210 (not illustrated in FIG. 5). The other end of the quartz tube 223 is connected to the gas inlet duct 220 through which gas is introduced to the interior of the quartz tube 223.

Referring to FIGS. 4A and 4B, the shower nozzle 216 having a rod shape and extending along the discharge surface of the plate electrode 219 is connected to the discharge surface side of the plate electrode 219, and one end of the shower nozzle 216 is connected to the gas inlet duct 215. The gas inlet duct 215 is connected to a second gas supply source (not illustrated in the drawings) disposed outside the deposition chamber 210. The base rotating unit 212 is installed in the deposition chamber 210. The base 214 has a cylindrical shape and may be loaded onto the base rotating unit 212 through the base supporting unit 213 so that the base 214 faces the shower nozzle 216 in such a manner that the longitudinal direction of the shower nozzle 216 coincides with the axial direction of the base 214. During film deposition, the base rotating unit 212 rotates so as to turn the base 214 in the circumferential direction. An example of the base 214 is a photosensitive member that includes layers up to an organic photosensitive layer formed in advance.

The inorganic protective layer is formed as follows, for example.

First, oxygen gas (or helium (He)-diluted oxygen gas), helium (He) gas, and optionally hydrogen ($H_2$) gas are introduced to the interior of the high-frequency discharge tube 221 through the gas inlet duct 220, and at the same time, a 13.56 MHz radio wave is supplied to the plate electrode 219 from the high-frequency power supply unit 218. During this process, the plasma diffusing unit 217 that spreads radially from the discharge surface side of the plate electrode 219 toward the exhaust 211 is formed. The gas introduced from the gas inlet duct 220 flows in the deposition chamber 210 from the plate electrode 219 side toward the exhaust 211 side. The plate electrode 219 may be surrounded by an earth shield.

Next, trimethyl gallium gas is introduced into the deposition chamber 210 through the gas inlet duct 215 and the shower nozzle 216 located downstream of the plate electrode 219, which serves as an activating unit, so as to form a non-single-crystal film containing gallium, oxygen, and hydrogen on the surface of the base 214. For example, a base on which an organic photosensitive layer is formed is used as the base 214.

The temperature of the surface of the base 214 during deposition of the inorganic protective layer is 150° C. or lower, preferably 100° C. or lower, and more preferably 30° C. to 100° C. since an organic photosensitive member having an organic photosensitive layer is used.

Even if the temperature of the surface of the base 214 is 150° C. or lower at the beginning of the deposition, the temperature may become higher than 150° C. due to the effect of the plasma. In such a case, the organic photosensitive layer may be damaged by heat. Thus, the surface temperature of the base 214 is to be controlled by taking into account this effect.

The temperature of the surface of the base 214 may be controlled by using a heating and/or cooling device (not illustrated in the drawings) or may be left to naturally increase as a result of discharge. In the case where the base 214 is heated, a heater may be installed on the outer side or inner side of the base 214. In the case where the base 214 is cooled, gas or liquid for cooling may be provided to circulate on the inner side of the base 214.

In the case where the increase in temperature of the surface of the base 214 caused by discharge is to be avoided, the increase may be effectively avoided by adjusting the high-energy gas flow applied to the surface of the base 214. In such a case, the conditions such as gas flow rate, discharge output, and pressure are adjusted so that the intended temperature is obtained.

Instead of trimethyl gallium gas, an organic metal compound containing aluminum or a hydride such as diborane may be used. Two or more of these may be used as a mixture. For example, in the initial stage of forming an inorganic protective layer, trimethyl indium may be introduced into the deposition chamber 210 through the gas inlet duct 215 and the shower nozzle 216 so as to form a film containing nitrogen and indium on the base 214. In such a case, this film absorbs ultraviolet rays that are generated during the subsequent film deposition and that deteriorate the organic photosensitive layer. As a result, damage onto the organic photosensitive layer inflicted by generation of ultraviolet rays during film deposition is suppressed.

In order to perform doping with a dopant during film deposition, $SiH_3$ or $SnH_4$ in a gas state is used for n-type doping, and biscyclopentadienylmagnesium, dimethyl calcium, dimethyl strontium, or the like in a gas state is used for p-type doping. In order to dope the surface layer with dopant atoms, a commonly used technique, such as a thermal diffusion technique or an ion implantation technique, may be employed. Specifically, for example, gas containing at least one dopant atoms is introduced into the deposition chamber 210 through the gas inlet duct 215 and the shower nozzle 216 so as to obtain an inorganic protective layer having a particular conductivity type such as n-type or p-type.

In the film forming device illustrated in FIGS. 4A, 4B, and 5, active nitrogen or active hydrogen formed by discharge energy may be independently controlled by providing plural activating devices. Alternatively, gas simultaneously containing nitrogen atoms and hydrogen atoms, such as $NH_3$ may be used. Yet alternatively, $H_2$ may be added. Conditions that generate free active hydrogen from the organic metal compound may be employed.

As a result, activated carbon atoms, gallium atoms, nitrogen atoms, hydrogen atoms, and the like are present on the surface of the base 214 in a controlled manner. The activated hydrogen atoms have an effect of inducing desorption of hydrogen atoms in a molecular form from hydrocarbon groups such as methyl and ethyl groups constituting the organic metal compound. Accordingly, a hard film (inorganic protective layer) constituting three-dimensional bonds is formed.

The plasma generator of the film forming device illustrated in FIGS. 4A, 4B, and 5 uses a high-frequency oscillator; however, the plasma generator is not limited to this. For example, a microwave oscillator, an electrocyclotron resonance plasma source, or a helicon plasma source may be used. The high-frequency oscillator may be of an induction type or a capacitance type. Two or more of these devices of different types may be used in combination, or two or more devices of the same type may be used in combination. A high-frequency oscillator may be used to suppress the increase in temperature of the surface of the base 214. Alternatively, a device that suppresses heat radiation may be provided.

In the case where two or more plasma generators of different types are used, adjustment may be made so that discharge is induced simultaneously at the same pressure. There may be a difference in pressure between the region where discharge is conducted and the region where deposition is conducted (region where the base is loaded). These devices may be arranged in series relative to the gas flow that flows from the portion where the gas is introduced to the portion where the gas is discharged in the film forming device. Alternatively, the devices may be arranged so that all of the devices face the deposition surface of the base.

For example, when two types of plasma generators are arranged in series relative to the gas flow in a film forming device illustrated in FIGS. 4A and 4B, the shower nozzle 216 serves as an electrode and is used as a second plasma generator that induces discharge in the deposition chamber 210. In such a case, for example, a high-frequency voltage is applied to the shower nozzle 216 through the gas inlet duct 215 so that discharge occurs in the deposition chamber 210 by using the shower nozzle 216 as an electrode. Alternatively, instead of using the shower nozzle 216 as an electrode, a cylindrical electrode is provided between the base 214 and the plate electrode 219 in the deposition chamber 210 and the cylindrical electrode is used to induce discharge in the deposition chamber 210. In the case where two different types of plasma generators are used at the same pressure, for example, when a microwave oscillator and a high-frequency oscillator are used, the excitation energies of the excitation species are markedly changed, which is effective for controlling the quality of the film. Discharge may be conducted at about an atmospheric pressure (70,000 Pa or more and 110,000 Pa or less). Helium (He) may be used as carrier gas in conducting discharge at about atmospheric pressure.

The inorganic protective layer is formed by, for example, placing a base 214, on which an organic photosensitive layer is formed, in the deposition chamber 210 and introducing mixed gas of different compositions to form an inorganic protective layer.

In the case where high-frequency discharge is to be conducted, for example, the frequency may be adjusted to be in the range of 10 kHz or more and 50 MHz or less in order to form a high-quality film at low temperature. The output depends on the size of the base 214 and may be in the range of 0.01 $W/cm^2$ or more and 0.2 $W/cm^2$ or less relative to the surface area of the base. The rotation speed of the base 214 may be in the range of 0.1 rpm or more and 500 rpm or less.

In the description above, an example of an electrophotographic photosensitive member in which the organic photosensitive layer is of a separated function type and the charge transport layer is of a single layer type is described. In the case of the electrophotographic photosensitive member illustrated in FIG. 2 (the organic photosensitive layer is of a separated function type and the charge transport layer is of a multilayer type), the charge transport layer 3A in contact with the inorganic protective layer 5 may have the same structure as the charge transport layer 3 of the electrophotographic photosensitive member illustrated in FIG. 1 and the charge transport layer 3B not in contact with the inorganic protective layer 5 may have the same structure as a typical charge transport layer. The thickness of the charge transport layer 3A may be 1 μm or more and 15 μm or less. The thickness of the charge transport layer 3B may be 15 μm or more and 29 μm or less.

In the case of the electrophotographic photosensitive member illustrated in FIG. 3 (example in which the organic photosensitive layer is of a single layer type), the single-layer-type organic photosensitive layer 6 (charge generation/charge transport layer) may have the same structure as the charge transport layer 3 of the electrophotographic photosensitive member except for incorporation of the charge generation material. The amount of the charge generation material in the single-layer-type organic photosensitive layer 6 may be 25% by weight or more and 50% by weight or less relative to the entire single-layer-type organic photosensitive layer. The thickness of the single-layer-type organic photosensitive layer 6 may be 15 μm or more and 30 μm or less.

Image Forming Apparatus (and Process Cartridge)

An image forming apparatus according to an exemplary embodiment includes an electrophotographic photosensitive member, a charging unit that charges a surface of the electrophotographic photosensitive member, an electrostatic latent image forming unit that forms an electrostatic latent image on the charged surface of the electrophotographic photosensitive member, a developing unit that forms a toner image by developing the electrostatic latent image on the surface of the electrophotographic photosensitive member by using a developer containing a toner, a transfer unit that transfers the toner image onto a surface of a recording medium, and a cleaning unit that cleans the surface of the photosensitive member. The electrophotographic photosensitive member of the aforementioned exemplary embodiment is used as the electrophotographic photosensitive member.

The image forming apparatus of this exemplary embodiment is applicable to commonly used image forming apparatuses such as follows: an apparatus equipped with a fixing unit that fixes the toner image transferred onto the surface of the recording medium; a direct-transfer-type apparatus that directly transfers the toner image formed on the surface of the electrophotographic photosensitive member onto the recording medium; an intermediate-transfer-type apparatus that transfers the toner image formed on the surface of the electrophotographic photosensitive member onto a surface of an intermediate transfer body (first transfer) and then transfers the toner image on the surface of the intermediate transfer body onto a surface of the recording medium (second transfer); an apparatus equipped with a cleaning unit that cleans the surface of the electrophotographic photosensitive member after the transfer of the toner image and before charging; an apparatus equipped with a charge erasing unit that applies charge erasing light onto the surface of the electrophotographic photosensitive member after the transfer of the toner image and before charging; and an apparatus equipped with a member that heats the electrophotographic photosensitive member in order to increase the temperature of the electrophotographic photosensitive member and decrease the relative temperature.

According to the intermediate-transfer-type apparatus, the transfer unit includes an intermediate transfer body having a surface onto which a toner image is transferred, a first transfer unit that transfers the toner image on the surface of the electrophotographic photosensitive member onto a surface of the intermediate transfer body, and a second transfer unit that transfers the toner image on the surface of the intermediate transfer body onto a surface of a recording medium.

The image forming apparatus of this exemplary embodiment may be a dry-development type image forming apparatus or a wet-development type image forming apparatus (development is conducted by using a liquid developer).

In the image forming apparatus of this exemplary embodiment, for example, the portion equipped with an electrophotographic photosensitive member may have a cartridge structure (process cartridge) detachably attachable to the image forming apparatus. An example of the process cartridge is a process cartridge that includes the electrophotographic photosensitive member of the exemplary embodiment. The process cartridge may include, in addition to the electrophotographic photosensitive member, at least one selected from the group consisting of a charging unit, an electrostatic latent image forming unit, a developing unit, and a transfer unit.

A non-limiting example of the image forming apparatus of the exemplary embodiment is described below. The components illustrated in the drawings are described, and the descriptions of other components not illustrated in the drawings are omitted.

Figure 6:
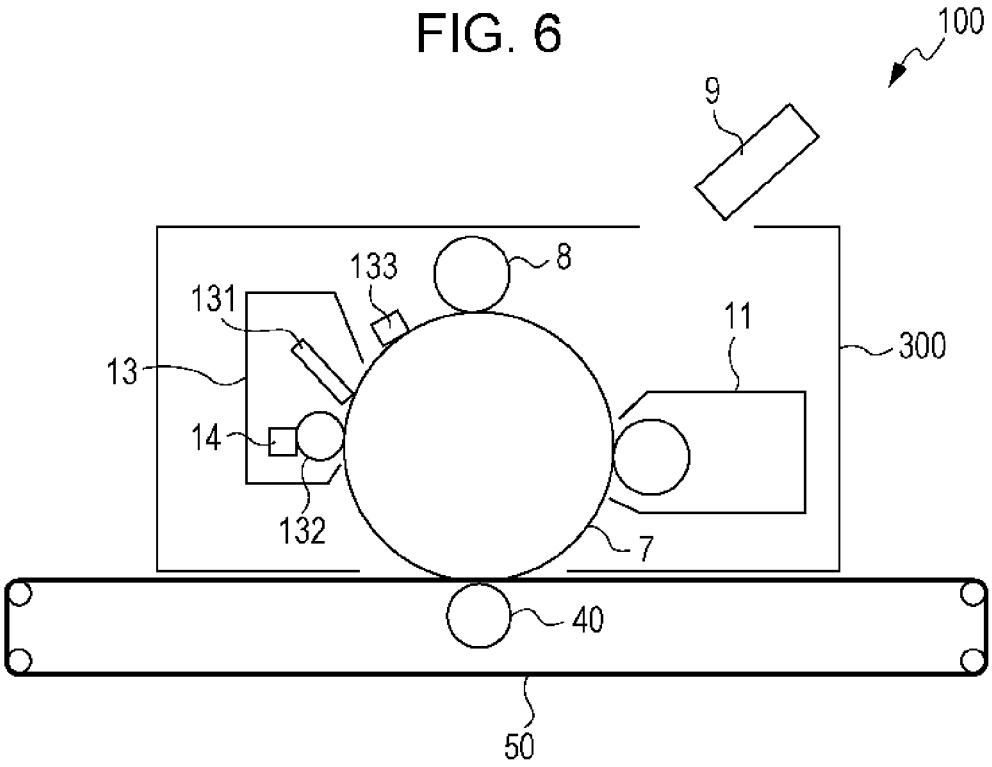
FIG. 6 is a schematic diagram illustrating an example of an image forming apparatus according to an exemplary embodiment.

FIG. 6 is a schematic diagram illustrating an example of the image forming apparatus of the exemplary embodiment. Referring to FIG. 6, an image forming apparatus 100 of the exemplary embodiment includes a process cartridge 300 that includes an electrophotographic photosensitive member 7, an exposing device 9 (an example of an electrostatic latent image forming unit), a transfer device 40 (first transfer device), and an intermediate transfer body 50. In the image forming apparatus 100, the exposing device 9 is located at a position such that the exposing device 9 applies light to the electrophotographic photosensitive member 7 through an opening in the process cartridge 300. The transfer device 40 is located at a position such that the transfer device 40 opposes the electrophotographic photosensitive member 7 with the intermediate transfer body 50 therebetween. The intermediate transfer body 50 is arranged so that a part of the intermediate transfer member 50 contacts the electrophotographic photosensitive member 7. Although not illustrated in the drawing, a second transfer device that transfers the toner image on the intermediate transfer body 50 onto a recording medium (for example, paper sheet) is also provided. The intermediate transfer body 50, the transfer device 40 (first transfer device), and the second transfer device (not illustrated in the drawing) correspond to examples of the transfer unit.

The process cartridge 300 illustrated in FIG. 6 integrally supports the electrophotographic photosensitive member 7, a charging device 8 (an example of a charging unit), a developing device 11 (an example of a developing unit), and a cleaning device 13 (an example of a cleaning unit) in the housing. The cleaning device 13 includes a cleaning blade (an example of a cleaning member) 131, and the cleaning blade 131 is arranged to make contact with a surface of the electrophotographic photosensitive member 7. The cleaning member may be a conductive or insulating fibrous member instead of the cleaning blade 131. The conductive or insulating fibrous member may be used alone or in combination with the cleaning blade 131.

FIG. 6 illustrates an example of the image forming apparatus that includes a fibrous member 132 (roll shape) that supplies a lubricant 14 onto the surface of the electrophotographic photosensitive member 7, and a fibrous member 133 (flat brush shape) that assists cleaning. These parts are arranged as needed.

Individual components of the image forming apparatus of the exemplary embodiment will now be described.

Charging Device

Examples of the charging device 8 include contact-type chargers that use conductive or semi-conductive charging rollers, charging brushes, charging films, charging rubber blades, and charging tubes; and non-contact-type chargers known in the art such as non-contact-type roller chargers and scorotron chargers and corotron chargers that use corona discharge.

Exposing Device

An example of the exposing device 9 is an optical device that illuminates the surface of the electrophotographic photosensitive member 7 by light from a semiconductor laser, an LED, or a liquid crystal shutter so as to form an intended light image on the surface. The wavelength of the light source is to be within the region of the spectral sensitivity of the electrophotographic photosensitive member. The mainstream semiconductor lasers are infrared lasers having an oscillation wavelength around 780 nm. The wavelength is not limited to this, and a laser that has an oscillation wavelength on the order of 600 nm or a blue laser that has an oscillation wavelength of 400 nm or more and 450 nm or less may also be used. A surface-emission type laser light source capable of outputting a multibeam is effective for forming color images.

Developing Device

An example of the developing device 11 is a typical developing device that conducts development by using a developer in a contact or non-contact manner. The developing device 11 may be any device that has this function and is selected according to the purpose. An example thereof is a known developing device that has a function of causing a one-component or two-component developer to attach to the electrophotographic photosensitive member 7 by using a brush, a roller, or the like. In particular, the developing device may use a development roller that retains the developer on the surface thereof.

The developer used in the developing device 11 may be a one-component developer formed of a toner alone or may be a two-component developer formed of a toner and a carrier. The developer may be magnetic or non-magnetic. Known developers may be used as the developer.

Cleaning Device

A cleaning blade-type device equipped with the cleaning blade 131 is used as the cleaning device 13. A fur brush cleaning technique or a technique of performing development and cleaning simultaneously may be employed instead of or in addition to the cleaning blade.

Transfer Device

Examples of the transfer device 40 include contact-type transfer chargers that use belts, rollers, films, rubber blades, etc., and scorotron transfer chargers and corotron transfer chargers that use corona discharge known in the art.

Intermediate Transfer Body

The intermediate transfer body 50 may be a belt-shaped member (intermediate transfer belt) that contains a polyimide, a polyamideimide, a polycarbonate, a polyarylate, a polyester, rubber, or the like that is made semi-conductive. The intermediate transfer body may have a drum shape instead of the belt shape.

Figure 7:
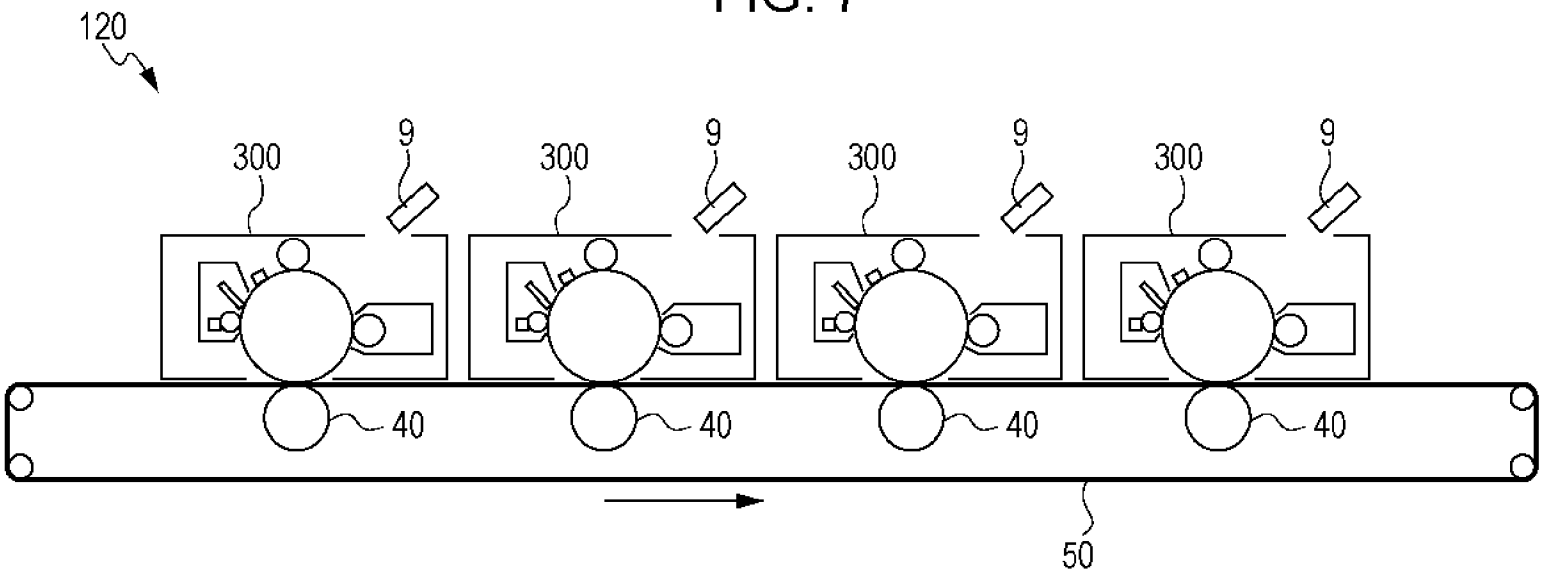
FIG. 7 is a schematic diagram illustrating another example of an image forming apparatus according to an exemplary embodiment.

FIG. 7 is a schematic diagram illustrating another example of the image forming apparatus of the exemplary embodiment. An image forming apparatus 120 illustrated in FIG. 7 is a multi-color image forming apparatus of a tandem-type equipped with four process cartridges 300. In the image forming apparatus 120, four process cartridges 300 are arranged side-by-side on the intermediate transfer body 50. One electrophotographic photosensitive member is used for one color. The image forming apparatus 120 has the same structure as the image forming apparatus 100 except for that the image forming apparatus 120 is of a tandem type.

The structure of the image forming apparatus 100 is not limited to one described above. For example, a first charge erasing device that makes the polarity of the residual toner uniform so that the residual toner may be easily removed may be provided around the electrophotographic photosensitive member 7, on the downstream side of the transfer device 40 in the electrophotographic photosensitive member 7 rotation direction and on the upstream side of the cleaning device 13 in the electrophotographic photosensitive member rotating direction. Alternatively, a second charge erasing device that erases charges from the surface of the electrophotographic photosensitive member 7 may be provided on the downstream side of the cleaning device 13 in the electrophotographic photosensitive member rotating direction and on the upstream side of the charging device 8 in the electrophotographic photosensitive member rotating direction.

The structure of the image forming apparatus 100 is not limited to one described above and may be, for example, any known direct-transfer-type image forming apparatus that directly transfers a toner image on the electrophotographic photosensitive member 7 onto a recording medium.

EXAMPLES

The present invention will now be specifically described by way of examples which do not limit the scope of the present invention. In the examples below, "parts" means parts by weight.

Preparation and Manufacture of Silica Particles

Silica Particles (1)

To 100 parts by weight of untreated (hydrophilic) silica particles whose trade name is VP40 (produced by AEROSIL CO., LTD.), 30 parts by weight of trimethoxysilane (trade name: 1,1,1,3,3,3-hexamethyldisilazane produced by Tokyo Chemical Industry Co., Ltd.) is added, and the reaction is carried out for 24 hours. Then hydrophobized silica particles are obtained by filtering the resulting reaction product, and assumed to be silica particles (1).

Silica Particles (2) to (4)

Hydrophobized silica particles are obtained as in the method for obtaining the silica particles (1) except that the diameter of the silica particles is changed. Silica particles (3) are silica particles that had been hydrophobized in advance.

TABLE 1

| | Volume-average particle diameter (nm) | Hydrophobing agent Type |
|---|---|---|
| Silica particles (1) | 80 | Trimethylsilane |
| Silica particles (2) | 40 | Trimethylsilane |
| Silica particles (3) | 120 | Trimethylsilane |
| Silica particles (4) | 300 | Trimethylsilane |

The details of the silica particles indicated in Table 1 are as follows.

Silica particles (2): hydrophobic silica particles obtained by hydrophobing untreated (hydrophilic) silica particles, trade name: OX50 (produced by AEROSIL CO., LTD.)

Silica particles (3): hydrophobic silica particles, trade name: X24-9163A (produced by Shin-Etsu Chemical Co., Ltd.)

Silica particles (4): hydrophobic silica particles obtained by hydrophobing untreated (hydrophilic) silica, trade name: SFP-20M (produced by Denka Company Limited)

Example 1

Manufacture of Undercoat Layer

Zinc oxide (average particle diameter: 70 nm, produced by Tayca Corporation, specific surface area: 15 $m^2/g$) in an amount of 100 parts by weight is mixed and stirred with 500 parts by weight of tetrahydrofuran, and 1.3 parts by weight of a silane coupling agent (KBM503 produced by Shin-Etsu Chemical Co., Ltd.) is added to the resulting mixture, followed by stirring for 2 hours. Then tetrahydrofuran is distilled away at a reduced pressure, and baking is conducted at 120° C. for 3 hours. As a result, zinc oxide surface-treated with a silane coupling agent is obtained.

The surface-treated zinc oxide in an amount of 110 parts by weight is mixed and stirred with 500 parts by weight of tetrahydrofuran. A solution prepared by dissolving 0.6 part by weight of alizarin in 50 parts by weight of tetrahydrofuran is added to the resulting mixture, followed by stirring at 50° C. for 5 hours. The alizarin-added zinc oxide is filtered out by vacuum filtration and dried at 60° C. at a reduced pressure. As a result, alizarin-added zinc oxide is obtained.

A solution is prepared by dissolving 60 parts by weight of the alizarin-added zinc oxide, 13.5 parts by weight of a curing agent (blocked isocyanate, Sumidur 3175 produced by Sumitomo Bayer Urethane Co., Ltd.), and 15 parts by weight of butyral resin (S-LEC BM-1 produced by Sekisui Chemical Co., Ltd.) in 85 parts by weight of methyl ethyl ketone, and 38 parts by weight of this solution is mixed with 25 parts by weight of methyl ethyl ketone. The resulting mixture is dispersed for 2 hours in a sand mill using glass beads 1 mm in diameter to obtain a dispersion.

To the dispersion, 0.005 part by weight of dioctyltin dilaurate and 40 parts by weight of silicone resin particles (Tospearl 145 produced by Momentive Performance Materials Inc.) are added to obtain a coating solution for forming an undercoat layer. The coating solution is applied to an aluminum base having a diameter of 60 mm, a length of 357 mm, and a thickness of 1 mm by a dip coating technique and cured by drying at 170° C. for 40 minutes. As a result, an undercoat layer having a thickness of 19 μm is obtained.

Manufacture of Charge Generation Layer

A mixture containing 15 parts by weight of hydroxygallium phthalocyanine serving as a charge generation material and at least having diffraction peaks at Bragg angles (2θ±0.2° of 7.3°, 16.0°, 24.9°, and 28.0° in an X-ray diffraction spectrum taken with a Cukα characteristic X-ray, 10 parts by weight of a vinyl chloride-vinyl acetate copolymer (VMCH produced by Nippon Unicar Company Limited) serving as a binder resin, and 200 parts by weight of n-butyl acetate is dispersed for 4 hours in a sand mill with glass beads having a diameter of 1 mm. To the resulting dispersion, 175 parts by weight of n-butyl acetate and 180 parts by weight of methyl ethyl ketone are added, followed by stirring. As a result, a coating solution for forming a charge generation layer is obtained. The coating solution for forming a charge generation layer is applied to the undercoat layer by dip coating, and dried at room temperature (25° C.). As a result, a charge generation layer having a thickness of 0.2 μm is obtained.

Manufacture of Charge Transport Layer

To 50 parts by weight of the silica particles (1), 250 parts by weight of tetrahydrofuran is added. While maintaining the temperature of the resulting mixture to 20° C., 25 parts by weight of 4-(2,2-diphenylethyl)-4',4"-dimethyl-triphenylamine and 25 parts by weight of bisphenol Z-type polycarbonate resin (viscosity-average molecular weight: 20,000) serving as a binder resin are added, followed by mixing and stirring for 12 hours. As a result, a coating solution for forming a charge transport layer is obtained.

The coating solution for forming a charge transport layer is applied to the charge generation layer and dried at 135° C. for 40 minutes to form a charge transport layer having a thickness of 30 μm. Thus, an electrophotographic photosensitive member is obtained.

Through the steps described above, an organic photosensitive member (1) including an aluminum base, and an undercoat layer, a charge generation layer, and a charge transport layer stacked in that order on the aluminum base is obtained.

Formation of Inorganic Protective Layer

Next, an inorganic protective layer containing hydrogen-containing gallium oxide is formed on a surface of the organic photosensitive member (1). The inorganic protective layer is formed by using a film forming device having a structure illustrated in FIGS. 4A and 4B.

First, the organic photosensitive member (1) is placed on the base supporting unit 213 in the deposition chamber 210, and the deposition chamber 210 is vacuum-evacuated through the exhaust 211 until the pressure is 0.1 Pa. The vacuum evacuation is conducted within 5 minutes after completion of substitution of the gas containing oxygen at high concentration.

Next, 40% oxygen gas diluted with He (flow rate: 1.6 sccm) and hydrogen gas (flow rate: 50 sccm) are introduced from the gas inlet duct 220 into the high-frequency discharge tube 221 equipped with the plate electrode 219 having a diameter of 85 mm. The high-frequency power supply unit 218 and a matching circuit (not illustrated in FIGS. 4A and 4B) are used to set the output of the 13.56 MHz radio wave to 150 W, and discharge is conducted from the plate electrode 219 while conducting matching with a tuner. The returning wave is 0 W.

Next, trimethylgallium gas (flow rate: 1.9 sccm) is introduced from the shower nozzle 216 to the plasma diffusing unit 217 in the deposition chamber 210 through the gas inlet duct 215. The reaction pressure inside the deposition chamber 210 measured by a Baratron vacuum meter is 5.3 Pa.

Under such conditions, while the organic photosensitive member (1) is rotated at a rate of 500 rpm, a film is formed for 68 minutes. As a result, an inorganic protective layer having a thickness of 1.5 μm is formed on the surface of the charge transport layer of the organic photosensitive member (1).

Through the steps described above, an electrophotographic photosensitive member of Example 1 in which an undercoat layer, a charge generation layer, a charge transport layer, and an inorganic protective layer are sequentially stacked on a conductive base is obtained.

Examples 2 to 10 and Comparative Examples 1 to 8

Electrophotographic photosensitive members of Examples 2 to 10 and Comparative Examples 1 to 8 are obtained as in Example 1 except that the type of the binder resin and type and amount of the silica particles used in the charge transport layer are changed as indicated in Table 2. The quantity of the silica particles in percent by weight indicated in Table 2 is relative to the entire charge transport layer assumed to be 100.

Evaluation

AFM Surface Roughness Ra

For each of the electrophotographic photosensitive members of the examples, the surface roughness Ra of the surface of the charge transport layer on which the inorganic protective layer is to be formed is measured by a procedure already described.

Evaluation of Image Deletion

Each of the electrophotographic photosensitive members obtained in the examples is loaded onto DocuCentre-V C7775 produced by Fuji Xerox Co. Ltd. A halftone image (image density: 30%) is output continuously on 20,000 sheets in a high-temperature high-humidity (28° C., 85% RH) environment at 200 lines per inch (lpi). The output images are left overnight in a high-temperature high-humidity environment (28° C., 85% RH). Then a halftone image (image density: 30%) is continuously output on 100 sheets, and images on the first sheet, the 20th sheet, and the 100th sheet are observed with naked eye.

The evaluation standards are as follows:

A: The resolution of the halftone image is maintained in the printed image on the first sheet.

B: Image deletion (decrease in resolution) is observed in some part of the printed image on the first sheet but not in the printed image on the 20th sheet.

C: Image deletion (decrease in resolution) is observed in some part of the printed image on the first sheet but not in the printed image on the 100th sheet.

D: Image deletion (decrease in resolution) is observed in some part of the printed image on the first sheet and also in the printed image on the 100th sheet.

E: A decrease in resolution is observed in the printed image immediately after continuous output on 20,000 sheets.

TABLE 2

| | Charge transport layer | | | | | | |
|---|---|---|---|---|---|---|---|
| | Silica particles | | | Binder resin | | AFM roughness | Evaluation of image deletion |
| | No. | D50v (nm) | Weight % | Type | Mv | (Ra) (nm) | |
| Example 1 | (1) | 80 | 50 | PCZ | 20,000 | 1.2 | A |
| Example 2 | (1) | 80 | 50 | PCZ | 30,000 | 2.3 | B |
| Comparative Example 1 | (1) | 80 | 50 | PCZ | 50,000 | 3.59 | C |
| Comparative Example 2 | (1) | 80 | 50 | PCZ | 80,000 | 8.0 | D |
| Example 3 | (1) | 80 | 50 | PCA | 20,000 | 2.11 | B |
| Example 4 | (1) | 80 | 50 | PCC | 20,000 | 1.6 | A |
| Comparative Example 3 | (1) | 80 | 50 | PCC | 50,000 | 3.8 | C |
| Comparative Example 4 | (1) | 80 | 50 | BPZ | 60,000 | 5.3 | D |
| Example 5 | (1) | 80 | 50 | BPC | 27,000 | 2.3 | B |
| Example 6 | (1) | 80 | 50 | BPC | 45,000 | 3.0 | B |
| Example 7 | (1) | 80 | 50 | PS | 30,000 | 2.3 | B |
| Comparative Example 5 | (1) | 80 | 50 | PαMS | 68,000 | 7.23 | D |
| Comparative Example 6 | (1) | 80 | 50 | PS | 80,000 | 7.15 | D |
| Comparative Example 7 | (2) | 40 | 50 | PCZ | 50,000 | 8.0 | D |
| Example 8 | (1) | 80 | 50 | PCZ | 40,000 | 2.8 | B |
| Example 9 | (2) | 40 | 40 | PCZ | 40,000 | 2.7 | B |
| Example 10 | (3) | 120 | 50 | PCZ | 30,000 | 2.1 | B |
| Comparative Example 8 | (4) | 300 | 50 | PCZ | 50,000 | 3.5 | E |

The above-described results indicate that evaluation results regarding image deletion are better in Examples than in Comparative Examples.

Abbreviations used in Table 2 are as follows:

"D50V" in the silica particle column indicates the volume-average particle diameter.

"Mv" in the binder resin column indicates the viscosity-average molecular weight.

"PCZ" indicates a bisphenol Z homopolymeric polycarbonate resin (TS2020 with Mv 20,000 produced by Teijin Limited; TS2030 with Mv 30,000 produced by Teijin Limited; TS2050 with Mv 50,000 produced by Teijin Limited; and TS2040 with Mv 40,000 produced by Teijin Limited).

"PCA" indicates a bisphenol A homopolymeric polycarbonate resin (AD-5503 with Mv 20,000, produced by Teijin Limited).

"PCC" indicates a bisphenol C homopolymeric polycarbonate resin (Mv 20,000 produced by Teijin Limited; and Mv 50,000 produced by Teijin Limited).

"BPZ" indicates a biphenyl copolymer polycarbonate resin (TS-2745 with Mv of 60,000 produced by Teijin Limited) having a biphenyl skeleton and a bisphenol Z skeleton.

"BPC" indicates a biphenyl copolymer polycarbonate resin (Mv 27,000 produced by Teijin Limited and Mv 45,000 produced by Teijin Limited) having a biphenyl skeleton and a bisphenol C skeleton.

"PS" indicates a polystyrene resin (produced by Aldrich).

"PαEMS" indicates a poly-α-methylstyrene resin (produced by Polysciences, Inc.).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photosensitive member comprising:

a conductive base;

an organic photosensitive layer disposed on the conductive base, the organic photosensitive layer including a surface layer that contains a charge transport material, a binder resin having a viscosity-average molecular weight less than 30,000, and silica particles in an amount of 40% by weight or more relative to the weight of the surface layer; and an inorganic protective layer disposed on the surface layer, wherein the silica particles have a volume-average particle diameter of 20 nm or more and 200 nm or less, and a surface roughness of the surface layer is 2.5 nm or less.

2. The electrophotographic photosensitive member according to claim 1, wherein the organic photosensitive layer includes a charge generation layer and a charge transport layer stacked on the conductive base in that order, the charge transport layer being the surface layer.

3. The electrophotographic photosensitive member according to claim 1, wherein the silica particles are contained in an amount of 45% by weight or more.

4. The electrophotographic photosensitive member according to claim 1, wherein the silica particles are contained in an amount of 50% by weight or more.

5. The electrophotographic photosensitive member according to claim 1, wherein the binder resin contains a bisphenol Z homopolymeric polycarbonate resin.

6. The electrophotographic photosensitive member according to claim 1, wherein the silica particles are hydrophobic silica particles.

7. A process cartridge detachably attachable to an image forming apparatus, comprising:

the electrophotographic photosensitive member according to claim 1.

8. An image forming apparatus comprising:

the electrophotographic photosensitive member according to claim 1;

a charging unit that charges the electrophotographic photosensitive member;

an electrostatic latent image forming unit that forms an electrostatic latent image on the electrophotographic photosensitive member in a charged state;

a developing unit that develops the electrostatic latent image on the electrophotographic photosensitive member with a developer containing a toner so as to form a toner image;

a transfer unit that transfers the toner image onto a recording medium; and a cleaning unit that cleans the electrophotographic photosensitive member.

* * * * *